US010608353B2

(12) United States Patent
Lipkin et al.

(10) Patent No.: US 10,608,353 B2
(45) Date of Patent: Mar. 31, 2020

(54) BATTERY CLAMP

(71) Applicant: Midtronics, Inc., Willowbrook, IL (US)

(72) Inventors: Luba Lipkin, Buffalo Grove, IL (US); Andrew John Salo, III, Hinsdale, IL (US); Kevin I. Bertness, Batavia, IL (US)

(73) Assignee: MIDTRONICS, INC., Willowbrook, IL (US)

( * ) Notice: Subject to any disclaimer, the term of this patent is extended or adjusted under 35 U.S.C. 154(b) by 77 days.

(21) Appl. No.: 15/634,491

(22) Filed: Jun. 27, 2017

(65) Prior Publication Data

US 2017/0373410 A1 Dec. 28, 2017

Related U.S. Application Data

(60) Provisional application No. 62/355,465, filed on Jun. 28, 2016.

(51) Int. Cl.
*H01R 11/24* (2006.01)
*H01R 11/28* (2006.01)

(52) U.S. Cl.
CPC ..... *H01R 11/24* (2013.01); *H01R 11/281* (2013.01)

(58) Field of Classification Search
CPC .. H01R 11/24; H01R 11/281; H01R 2201/26; B25B 7/205; B02B 7/12; F16B 21/00; F16B 21/09; F16N 39/06
(Continued)

(56) References Cited

U.S. PATENT DOCUMENTS 85,553 A 1/1869 Adams ..... 33/472
2,000,665 A 5/1935 Neal ..... 439/440
(Continued)

FOREIGN PATENT DOCUMENTS

CN 2470964 Y 1/2002
CN 201063352 Y 5/2008
(Continued)

OTHER PUBLICATIONS

"Electrochemical Impedance Spectroscopy in Battery Development and Testing", *Batteries International*, Apr. 1997, pp. 59 and 62-63.
(Continued)

*Primary Examiner* — Amy Cohen Johnson
*Assistant Examiner* — Paul D Baillargeon
(74) *Attorney, Agent, or Firm* — Westman, Champlin & Koehler, P.A.

(57) ABSTRACT

A clamp for providing an electrical connection to a battery includes a first arm, a second arm, a joint member, a first pivotable connection, and a second pivotable connection. The first arm includes a proximal end, a distal end, and an electrically conductive member at the distal end. The second arm includes a proximal end and a distal end. The first pivotable connection is between the joint member and the first arm, and defines a first axis, about which the first arm rotates relative to the joint member. The second pivotable connection is between the joint member and the second arm, and defines a second axis, about which the second arm rotates relative to the joint member. The first and second axes are displaced from each other in a direction that is perpendicular to the first axis.

18 Claims, 5 Drawing Sheets

(58) Field of Classification Search
USPC ..... 439/759, 829; 81/302, 427
See application file for complete search history.

(56) References Cited

U.S. PATENT DOCUMENTS

| | | | | |
|---|---|---|---|---|
| 2,254,846 | A | 9/1941 | Heyer | 324/437 |
| 2,417,940 | A | 3/1947 | Lehman | 200/61.25 |
| 2,437,772 | A | 3/1948 | Wall | 324/523 |
| 2,514,745 | A | 7/1950 | Dalzell | 324/115 |
| 2,727,221 | A | 12/1955 | Springg | 340/447 |
| 3,025,455 | A | 3/1962 | Jonsson | 323/369 |
| 3,267,452 | A | 12/1963 | Wolf | 340/249 |
| 3,178,686 | A | 4/1965 | Mills | 340/447 |
| 3,215,194 | A | 11/1965 | Sununu et al. | 165/80.3 |
| 3,223,969 | A | 12/1965 | Alexander | 340/447 |
| 3,356,936 | A | 12/1967 | Smith | 324/429 |
| 3,562,634 | A | 2/1971 | Latner | 324/427 |
| 3,593,099 | A | 7/1971 | Scholl | 320/127 |
| 3,607,673 | A | 9/1971 | Seyl | 324/425 |
| 3,652,341 | A | 3/1972 | Halsall et al. | 29/623.2 |
| 3,676,770 | A | 7/1972 | Sharaf et al. | 324/430 |
| 3,699,433 | A | 10/1972 | Smith, Jr. | 324/523 |
| 3,704,439 | A * | 11/1972 | Nelson | H01R 4/00 439/269.1 |
| 3,729,989 | A | 5/1973 | Little | 73/862.192 |
| 3,745,441 | A | 7/1973 | Soffer | 290/14 |
| 3,750,011 | A | 7/1973 | Kreps | 324/430 |
| 3,753,094 | A | 8/1973 | Furuishi et al. | 324/430 |
| 3,776,177 | A | 12/1973 | Bryant et al. | 116/311 |
| 3,796,124 | A | 3/1974 | Crosa | 411/521 |
| 3,808,522 | A | 4/1974 | Sharaf | 324/430 |
| 3,811,089 | A | 5/1974 | Strezelewicz | 324/170 |
| 3,816,805 | A | 6/1974 | Terry | 320/123 |
| 3,850,490 | A | 11/1974 | Zehr | 439/822 |
| 3,857,082 | A | 12/1974 | Van Opijnen | 320/143 |
| 3,873,911 | A | 3/1975 | Champlin | 324/430 |
| 3,876,931 | A | 4/1975 | Godshalk | 324/429 |
| 3,879,654 | A | 4/1975 | Kessinger | 324/434 |
| 3,886,426 | A | 5/1975 | Daggett | 320/117 |
| 3,886,443 | A | 5/1975 | Miyakawa et al. | 324/426 |
| 3,889,248 | A | 6/1975 | Ritter | 340/636.11 |
| 3,906,329 | A | 9/1975 | Bader | 320/134 |
| 3,909,708 | A | 9/1975 | Champlin | 324/431 |
| 3,920,284 | A | 11/1975 | Lane et al. | 303/122.06 |
| 3,936,744 | A | 2/1976 | Perlmutter | 324/772 |
| 3,939,400 | A | 2/1976 | Steele | 324/434 |
| 3,946,299 | A | 3/1976 | Christianson et al. | 320/430 |
| 3,947,757 | A | 3/1976 | Grube et al. | 324/416 |
| 3,969,667 | A | 7/1976 | McWilliams | 324/427 |
| 3,979,664 | A | 9/1976 | Harris | 324/397 |
| 3,984,762 | A | 10/1976 | Dowgiallo, Jr. | 324/430 |
| 3,984,768 | A | 10/1976 | Staples | 324/712 |
| 3,989,544 | A | 11/1976 | Santo | 429/65 |
| 3,997,830 | A | 12/1976 | Newell et al. | 320/102 |
| 4,008,619 | A | 2/1977 | Alcaide et al. | 73/724 |
| 4,023,882 | A | 5/1977 | Pettersson | 439/426 |
| 4,024,953 | A | 5/1977 | Nailor, III | 206/344 |
| 4,047,091 | A | 9/1977 | Hutchines et al. | 363/59 |
| 4,053,824 | A | 10/1977 | Dupuis et al. | 324/434 |
| 4,056,764 | A | 11/1977 | Endo et al. | 320/101 |
| 4,057,313 | A | 11/1977 | Polizzano | 439/219 |
| 4,070,624 | A | 1/1978 | Taylor | 324/772 |
| 4,086,531 | A | 4/1978 | Bernier | 324/772 |
| 4,106,025 | A | 8/1978 | Katz | 343/715 |
| 4,112,351 | A | 9/1978 | Back et al. | 324/380 |
| 4,114,083 | A | 9/1978 | Benham et al. | 340/636.13 |
| 4,126,874 | A | 11/1978 | Suzuki et al. | 396/301 |
| 4,160,916 | A | 7/1979 | Papasideris | 307/10.6 |
| 4,176,315 | A | 11/1979 | Sunnarborg | 324/133 |
| 4,178,546 | A | 12/1979 | Hulls et al. | 324/772 |
| 4,193,025 | A | 3/1980 | Frailing et al. | 324/427 |
| 4,207,610 | A | 6/1980 | Gordon | 701/33.9 |
| 4,207,611 | A | 6/1980 | Gordon | 701/33 |
| 4,217,645 | A | 8/1980 | Barry et al. | 702/63 |
| 4,218,745 | A | 8/1980 | Perkins | 324/66 |
| 4,280,457 | A | 7/1981 | Bloxham | 123/198 R |
| 4,295,468 | A | 10/1981 | Bartelt | |
| 4,297,639 | A | 10/1981 | Branham | 324/429 |
| 4,307,342 | A | 12/1981 | Peterson | 324/767 |
| 4,315,204 | A | 2/1982 | Sievers et al. | 322/28 |
| 4,316,185 | A | 2/1982 | Watrous et al. | 340/636.11 |
| 4,322,685 | A | 3/1982 | Frailing et al. | 324/429 |
| 4,351,405 | A | 6/1982 | Fields et al. | 180/65.2 |
| 4,352,067 | A | 9/1982 | Ottone | 324/434 |
| 4,360,780 | A | 11/1982 | Skutch, Jr. | 324/437 |
| 4,361,809 | A | 11/1982 | Bil et al. | 324/426 |
| 4,363,407 | A | 12/1982 | Buckler et al. | 209/3.3 |
| 4,369,407 | A | 1/1983 | Korbell | 324/416 |
| 4,379,989 | A | 4/1983 | Kurz et al. | 320/165 |
| 4,379,990 | A | 4/1983 | Sievers et al. | 322/99 |
| 4,385,269 | A | 5/1983 | Aspinwall et al. | 320/129 |
| 4,390,828 | A | 6/1983 | Converse et al. | 320/153 |
| 4,392,101 | A | 7/1983 | Saar et al. | 320/156 |
| 4,396,880 | A | 8/1983 | Windebank | 320/156 |
| 4,408,157 | A | 10/1983 | Beaubien | 324/712 |
| 4,412,169 | A | 10/1983 | Dell'Orto | 320/123 |
| 4,423,378 | A | 12/1983 | Marino et al. | 324/427 |
| 4,423,379 | A | 12/1983 | Jacobs et al. | 324/429 |
| 4,424,491 | A | 1/1984 | Bobbett et al. | 324/433 |
| 4,425,791 | A | 1/1984 | Kling | 73/116.02 |
| 4,441,359 | A | 4/1984 | Ezoe | 73/116.06 |
| 4,459,548 | A | 7/1984 | Lentz et al. | 324/472 |
| 4,502,000 | A | 2/1985 | Mashikian | |
| 4,514,694 | A | 4/1985 | Finger | 324/429 |
| 4,520,353 | A | 5/1985 | McAuliffe | 340/636.16 |
| 4,521,498 | A | 6/1985 | Juergens | 429/59 |
| 4,544,312 | A * | 10/1985 | Stencel | F16B 39/06 411/167 |
| 4,560,230 | A | 12/1985 | Inglis | 439/890 |
| 4,564,798 | A | 1/1986 | Young | 320/103 |
| 4,620,767 | A | 11/1986 | Woolf | 439/217 |
| 4,626,765 | A | 12/1986 | Tanaka | 320/127 |
| 4,633,418 | A | 12/1986 | Bishop | 702/63 |
| 4,637,359 | A | 1/1987 | Cook | 123/179 |
| 4,643,511 | A | 2/1987 | Gawlik | 439/755 |
| 4,659,977 | A | 4/1987 | Kissel et al. | 320/150 |
| 4,663,580 | A | 5/1987 | Wortman | 320/153 |
| 4,665,370 | A | 5/1987 | Holland | 324/429 |
| 4,667,143 | A | 5/1987 | Cooper et al. | 320/153 |
| 4,667,279 | A | 5/1987 | Maier | 363/46 |
| 4,678,998 | A | 7/1987 | Muramatsu | 324/427 |
| 4,679,000 | A | 7/1987 | Clark | 324/428 |
| 4,680,528 | A | 7/1987 | Mikami et al. | 320/165 |
| 4,686,442 | A | 8/1987 | Radomski | 320/123 |
| 4,697,134 | A | 9/1987 | Burkum et al. | 320/134 |
| 4,707,795 | A | 11/1987 | Alber et al. | 702/63 |
| 4,709,202 | A | 11/1987 | Koenck et al. | 320/112 |
| 4,710,861 | A | 12/1987 | Kanner | 363/46 |
| 4,719,428 | A | 1/1988 | Liebermann | 324/436 |
| 4,723,656 | A | 2/1988 | Kiernan et al. | 206/705 |
| 4,743,855 | A | 5/1988 | Randin et al. | 324/430 |
| 4,745,349 | A | 5/1988 | Palanisamy et al. | 320/125 |
| 4,773,011 | A | 9/1988 | VanHoose | 701/30 |
| 4,781,629 | A | 11/1988 | Mize | 439/822 |
| D299,909 | S | 2/1989 | Casey | D10/77 |
| 4,816,768 | A | 3/1989 | Champlin | 324/428 |
| 4,820,966 | A | 4/1989 | Fridman | 320/116 |
| 4,825,170 | A | 4/1989 | Champlin | 324/436 |
| 4,826,457 | A | 5/1989 | Varatta | 439/504 |
| 4,847,547 | A | 7/1989 | Eng, Jr. et al. | 320/153 |
| 4,849,700 | A | 7/1989 | Morioka et al. | 324/427 |
| 4,874,679 | A | 10/1989 | Miyagawa | 429/91 |
| 4,876,495 | A | 10/1989 | Palanisamy et al. | 320/106 |
| 4,881,038 | A | 11/1989 | Champlin | 324/426 |
| 4,885,523 | A | 12/1989 | Koench | 230/131 |
| 4,888,716 | A | 12/1989 | Ueno | 702/63 |
| 4,901,007 | A | 2/1990 | Sworm | 324/110 |
| 4,907,176 | A | 3/1990 | Bahnick et al. | 364/551.01 |
| 4,912,416 | A | 3/1990 | Champlin | 324/430 |
| 4,913,116 | A | 4/1990 | Katogi et al. | 123/406.32 |
| 4,926,330 | A | 5/1990 | Abe et al. | 701/33 |
| 4,929,931 | A | 5/1990 | McCuen | 340/636.15 |
| 4,931,738 | A | 6/1990 | MacIntyre et al. | 324/435 |
| 4,932,905 | A | 6/1990 | Richards | 439/822 |

(56) References Cited

U.S. PATENT DOCUMENTS 4,933,845 A 6/1990 Hayes ..... 710/104
4,934,957 A 6/1990 Bellusci ..... 439/504
4,937,528 A 6/1990 Palanisamy ..... 324/430
4,947,124 A 8/1990 Hauser ..... 324/430
4,949,046 A 8/1990 Seyfang ..... 324/427
4,956,597 A 9/1990 Heavey et al. ..... 320/129
4,965,738 A 10/1990 Bauer et al. ..... 320/136
4,968,941 A 11/1990 Rogers ..... 324/428
4,968,942 A 11/1990 Palanisamy ..... 324/430
4,969,834 A 11/1990 Johnson ..... 439/141
4,983,086 A 1/1991 Hatrock ..... 411/259
5,004,979 A 4/1991 Marino et al. ..... 324/160
5,030,916 A 7/1991 Bokitch ..... 324/503
5,032,825 A 7/1991 Kuznicki ..... 340/636.15
5,034,893 A 7/1991 Fisher ..... 701/99
5,037,335 A 8/1991 Campbell ..... 439/217
5,037,778 A 8/1991 Stark et al. ..... 228/121
5,047,722 A 9/1991 Wurst et al. ..... 324/430
5,081,565 A 1/1992 Nabha et al. ..... 362/465
5,083,076 A 1/1992 Scott ..... 320/105
5,087,881 A 2/1992 Peacock ..... 324/378
5,095,223 A 3/1992 Thomas ..... 307/110
5,108,320 A 4/1992 Kimber ..... 439/883
5,109,213 A 4/1992 Williams ..... 340/447
5,126,675 A 6/1992 Yang ..... 324/435
5,130,658 A 7/1992 Bohmer ..... 324/435
5,140,269 A 8/1992 Champlin ..... 324/433
5,144,218 A 9/1992 Bosscha ..... 320/139
5,144,248 A 9/1992 Alexandres et al. ..... 324/428
D330,338 S 10/1992 Wang ..... D10/77
5,159,272 A 10/1992 Rao et al. ..... 324/429
5,160,881 A 11/1992 Schramm et al. ..... 322/7
5,164,653 A 11/1992 Reem
5,167,529 A 12/1992 Verge ..... 427/1
5,168,208 A 12/1992 Schultz et al. ..... 322/25
5,170,124 A 12/1992 Blair et al. ..... 324/434
5,179,335 A 1/1993 Nor ..... 320/159
5,187,382 A 2/1993 Kondo ..... 307/10.1
5,194,799 A 3/1993 Tomantschger ..... 320/103
5,204,611 A 4/1993 Nor et al. ..... 320/145
5,214,370 A 5/1993 Harm et al. ..... 320/152
5,214,385 A 5/1993 Gabriel et al. ..... 324/434
5,223,747 A 6/1993 Tschulena ..... 257/713
5,241,275 A 8/1993 Fang ..... 324/430
5,254,952 A 10/1993 Salley et al. ..... 324/429
5,266,880 A 11/1993 Newland ..... 320/125
5,278,759 A 1/1994 Berra et al. ..... 701/1
5,281,919 A 1/1994 Palanisamy ..... 324/427
5,281,920 A 1/1994 Wurst ..... 324/430
5,295,078 A 3/1994 Stich et al. ..... 700/297
5,296,823 A 3/1994 Dietrich ..... 333/161
5,298,797 A 3/1994 Redl ..... 327/387
5,300,874 A 4/1994 Shimamoto et al. ..... 320/106
5,302,902 A 4/1994 Groehl ..... 324/434
5,309,052 A 5/1994 Kim ..... 74/350
5,313,152 A 5/1994 Wozniak et al. ..... 320/118
5,315,287 A 5/1994 Sol ..... 340/455
5,321,626 A 6/1994 Palladino ..... 702/63
5,321,627 A 6/1994 Reher ..... 702/63
5,323,337 A 6/1994 Wilson et al. ..... 702/73
5,325,041 A 6/1994 Briggs ..... 320/149
5,331,268 A 7/1994 Patino et al. ..... 320/158
5,332,927 A 7/1994 Paul et al. ..... 307/66
5,336,993 A 8/1994 Thomas et al. ..... 324/158.1
5,338,515 A 8/1994 Dalla Betta et al. ..... 422/95
5,339,018 A 8/1994 Brokaw ..... 320/147
5,343,380 A 8/1994 Champlin ..... 363/46
5,345,384 A 9/1994 Przybyla et al. ..... 701/29.1
5,347,163 A 9/1994 Yoshimura ..... 307/66
5,349,535 A 9/1994 Gupta ..... 320/106
5,352,968 A 10/1994 Reni et al. ..... 320/136
5,357,519 A 10/1994 Martin et al. ..... 371/15.1
5,365,160 A 11/1994 Leppo et al. ..... 320/160
5,365,453 A 11/1994 Startup et al. ..... 702/36
5,369,364 A 11/1994 Renirie et al. ..... 324/430
5,381,096 A 1/1995 Hirzel ..... 324/427
5,384,540 A 1/1995 Dessel ..... 324/539
5,387,871 A 2/1995 Tsai ..... 324/429
5,394,093 A 2/1995 Cervas ..... 324/556
5,402,007 A 3/1995 Center et al. ..... 290/40 B
5,410,754 A 4/1995 Klotzbach et al. ..... 370/466
5,412,308 A 5/1995 Brown ..... 323/267
5,412,323 A 5/1995 Kato et al. ..... 324/429
5,425,041 A 6/1995 Seko et al. ..... 372/45.01
5,426,371 A 6/1995 Salley et al. ..... 324/429
5,426,416 A 6/1995 Jefferies et al. ..... 340/664
5,430,645 A 7/1995 Keller ..... 364/424.01
5,432,025 A 7/1995 Cox ..... 29/65
5,432,426 A 7/1995 Yoshida ..... 320/160
5,434,495 A 7/1995 Toko ..... 320/135
5,435,185 A 7/1995 Eagan ..... 73/587
5,442,274 A 8/1995 Tamai ..... 320/146
5,445,026 A 8/1995 Eagan ..... 73/591
5,449,996 A 9/1995 Matsumoto et al. ..... 320/148
5,449,997 A 9/1995 Gilmore et al. ..... 320/148
5,451,881 A 9/1995 Finger ..... 324/433
5,453,027 A 9/1995 Buell et al. ..... 439/433
5,457,377 A 10/1995 Jonsson ..... 324/430
5,459,660 A 10/1995 Berra ..... 701/33
5,462,439 A 10/1995 Keith ..... 180/279
5,469,043 A 11/1995 Cherng et al. ..... 320/161
5,485,090 A 1/1996 Stephens ..... 324/433
5,486,123 A 1/1996 Miyazaki ..... 439/825
5,488,300 A 1/1996 Jamieson ..... 324/432
5,504,674 A 4/1996 Chen et al. ..... 705/4
5,508,599 A 4/1996 Koenck ..... 320/138
5,519,383 A 5/1996 De La Rosa ..... 340/636.15
5,528,148 A 6/1996 Rogers ..... 320/137
5,537,967 A 7/1996 Tashiro et al. ..... 123/192.1
5,541,489 A 7/1996 Dunstan ..... 320/134
5,546,317 A 8/1996 Andrieu ..... 702/63
5,548,273 A 8/1996 Nicol et al. ..... 340/439
5,550,485 A 8/1996 Falk ..... 324/772
5,561,380 A 10/1996 Sway-Tin et al. ..... 324/509
5,562,501 A 10/1996 Kinoshita et al. ..... 439/852
5,563,496 A 10/1996 McClure ..... 320/128
5,572,136 A 11/1996 Champlin ..... 324/426
5,573,611 A 11/1996 Koch et al. ..... 152/152.1
5,574,355 A 11/1996 McShane et al. ..... 320/161
5,578,915 A 11/1996 Crouch, Jr. et al. ..... 324/428
5,583,416 A 12/1996 Klang ..... 320/160
5,585,416 A 12/1996 Audett et al. ..... 522/35
5,585,728 A 12/1996 Champlin ..... 324/427
5,589,757 A 12/1996 Klang ..... 320/160
5,592,093 A 1/1997 Klingbiel ..... 324/426
5,592,094 A 1/1997 Ichikawa ..... 324/427
5,596,260 A 1/1997 Moravec et al. ..... 320/135
5,596,261 A 1/1997 Suyama ..... 320/152
5,598,098 A 1/1997 Champlin ..... 324/430
5,602,462 A 2/1997 Stich et al. ..... 323/258
5,606,242 A 2/1997 Hull et al. ..... 320/106
5,614,788 A 3/1997 Mullins et al. ..... 315/82
5,621,298 A 4/1997 Harvey ..... 320/134
5,631,536 A 5/1997 Tseng ..... 320/15
5,631,831 A 5/1997 Bird et al. ..... 701/34.4
5,633,985 A 5/1997 Severson et al. ..... 704/267
5,637,978 A 6/1997 Kellett et al. ..... 320/104
5,642,031 A 6/1997 Brotto ..... 320/156
5,644,212 A 7/1997 Takahashi ..... 320/134
5,650,937 A 7/1997 Bounaga ..... 702/65
5,652,501 A 7/1997 McClure et al. ..... 340/636.15
5,653,659 A 8/1997 Kunibe et al. ..... 477/111
5,654,623 A 8/1997 Shiga et al. ..... 320/106
5,656,920 A 8/1997 Cherng et al. ..... 324/431
5,661,368 A 8/1997 Deol et al. ..... 315/82
5,666,040 A 9/1997 Bourbeau ..... 320/118
5,675,234 A 10/1997 Greene ..... 340/636.11
5,677,077 A 10/1997 Faulk ..... 429/90
5,684,678 A 11/1997 Barrett ..... 363/17
5,685,734 A 11/1997 Kutz ..... 439/371
5,691,621 A 11/1997 Phuoc et al. ..... 320/134
5,699,050 A 12/1997 Kanazawa ..... 340/636.13
5,701,089 A 12/1997 Perkins ..... 324/772
5,705,929 A 1/1998 Caravello et al. ..... 324/430

(56) References Cited

U.S. PATENT DOCUMENTS 5,707,015 A 1/1998 Guthrie ..... 241/120
5,710,503 A 1/1998 Sideris et al. ..... 320/116
5,711,648 A 1/1998 Hammerslag ..... 414/800
5,712,795 A 1/1998 Layman et al. ..... 700/297
5,717,336 A 2/1998 Basell et al. ..... 324/430
5,717,937 A 2/1998 Fritz ..... 713/300
5,721,688 A 2/1998 Bramwell ..... 324/426
5,732,074 A 3/1998 Spaur et al. ..... 370/313
5,739,667 A 4/1998 Matsuda et al. ..... 320/128
5,744,962 A 4/1998 Alber et al. ..... 324/426
5,745,044 A 4/1998 Hyatt, Jr. et al. ..... 340/5.23
5,747,189 A 5/1998 Perkins ..... 429/91
5,747,909 A 5/1998 Syverson et al. ..... 310/156.56
5,747,967 A 5/1998 Muljadi et al. ..... 320/148
5,754,417 A 5/1998 Nicollini ..... 363/60
5,757,192 A 5/1998 McShane et al. ..... 324/427
5,760,587 A 6/1998 Harvey ..... 324/434
5,772,468 A 6/1998 Kowalski et al. ..... 439/506
5,773,962 A 6/1998 Nor ..... 20/134
5,773,978 A 6/1998 Becker ..... 324/430
5,778,326 A 7/1998 Moroto et al. ..... 701/22
5,780,974 A 7/1998 Pabla et al. ..... 315/82
5,780,980 A 7/1998 Naito ..... 318/139
5,789,899 A 8/1998 van Phuoc et al. ..... 320/112
5,793,359 A 8/1998 Ushikubo ..... 345/169
5,796,239 A 8/1998 van Phuoc et al. ..... 320/107
5,808,469 A 9/1998 Kopera ..... 324/434
5,811,979 A 9/1998 Rhein ..... 324/718
5,818,201 A 10/1998 Stockstad et al. ..... 320/119
5,818,234 A 10/1998 McKinnon ..... 324/433
5,820,407 A 10/1998 Morse et al. ..... 439/504
5,821,756 A 10/1998 McShane et al. ..... 324/430
5,821,757 A 10/1998 Alvarez et al. ..... 324/434
5,825,174 A 10/1998 Parker ..... 324/106
5,826,467 A * 10/1998 Huang ..... B25B 7/06 81/302
5,831,435 A 11/1998 Troy ..... 324/426
5,832,396 A 11/1998 Moroto et al. ..... 701/22
5,850,113 A 12/1998 Weimer et al. ..... 307/125
5,862,515 A 1/1999 Kobayashi et al. ..... 702/63
5,865,638 A 2/1999 Trafton ..... 439/288
5,869,951 A 2/1999 Takahashi ..... 320/104
5,870,018 A 2/1999 Person ..... 307/10.2
5,871,858 A 2/1999 Thomsen et al. ..... 429/7
5,872,443 A 2/1999 Williamson ..... 320/160
5,872,453 A 2/1999 Shimoyama et al. ..... 324/431
5,883,306 A 3/1999 Hwang ..... 73/146.8
5,884,202 A 3/1999 Arjomand ..... 701/31.4
5,895,440 A 4/1999 Proctor et al. ..... 702/63
5,903,154 A 5/1999 Zhang et al. ..... 324/437
5,903,716 A 5/1999 Kimber et al. ..... 395/114
5,912,534 A 6/1999 Benedict ..... 315/82
5,914,605 A 6/1999 Bertness ..... 324/430
5,916,287 A 6/1999 Arjomand et al. ..... 701/33.2
5,927,938 A 7/1999 Hammerslag ..... 414/809
5,929,609 A 7/1999 Joy et al. ..... 322/25
5,935,180 A 8/1999 Fieramosca et al. ..... 701/29.6
5,939,855 A 8/1999 Proctor et al. ..... 320/104
5,939,861 A 8/1999 Joko et al. ..... 320/122
5,945,829 A 8/1999 Bertness ..... 324/430
5,946,605 A 8/1999 Takahisa et al. ..... 455/68
5,950,144 A 9/1999 Hall et al. ..... 702/108
5,951,229 A 9/1999 Hammerslag ..... 414/398
5,953,322 A 9/1999 Kimball ..... 370/328
5,955,951 A 9/1999 Wischerop et al. ..... 340/572.8
5,961,561 A 10/1999 Wakefield, II ..... 701/29
5,961,604 A 10/1999 Anderson et al. ..... 709/229
5,963,012 A 10/1999 Garcia et al. ..... 320/106
5,969,625 A 10/1999 Russo ..... 340/636.19
5,973,598 A 10/1999 Beigel ..... 340/572.1
5,978,805 A 11/1999 Carson ..... 707/10
5,982,138 A 11/1999 Krieger ..... 320/105
5,990,664 A 11/1999 Rahman ..... 320/136
6,002,238 A 12/1999 Champlin ..... 320/134
6,005,489 A 12/1999 Siegle et al. ..... 340/825.69
6,005,759 A 12/1999 Hart et al. ..... 361/66
6,008,652 A 12/1999 Theofanopoulos et al. ..... 324/434
6,009,369 A 12/1999 Boisvert et al. ..... 701/99
6,016,047 A 1/2000 Notten et al. ..... 320/137
6,031,354 A 2/2000 Wiley et al. ..... 320/116
6,031,368 A 2/2000 Klippel et al. ..... 324/133
6,037,745 A 3/2000 Koike et al. ..... 320/104
6,037,749 A 3/2000 Parsonage ..... 320/132
6,037,751 A 3/2000 Klang ..... 320/160
6,037,777 A 3/2000 Champlin ..... 324/430
6,037,778 A 3/2000 Makhija ..... 324/433
6,046,514 A 4/2000 Rouillard et al. ..... 307/77
6,051,976 A 4/2000 Bertness ..... 324/426
6,055,468 A 4/2000 Kaman et al. ..... 701/29
6,061,638 A 5/2000 Joyce ..... 702/63
6,064,372 A 5/2000 Kahkoska ..... 345/173
6,072,299 A 6/2000 Kurle et al. ..... 320/112
6,072,300 A 6/2000 Tsuji ..... 320/116
6,075,339 A 6/2000 Reipur et al. ..... 320/110
6,081,098 A 6/2000 Bertness et al. ..... 320/134
6,081,109 A 6/2000 Seymour et al. ..... 324/127
6,081,154 A 6/2000 Ezell et al. ..... 327/540
6,087,815 A 7/2000 Pfeifer et al. ..... 323/282
6,091,238 A 7/2000 McDermott ..... 324/207.2
6,091,245 A 7/2000 Bertness ..... 324/426
6,094,033 A 7/2000 Ding et al. ..... 320/132
6,097,193 A 8/2000 Bramwell ..... 324/429
6,100,670 A 8/2000 Levesque ..... 320/150
6,100,815 A 8/2000 Pailthorp ..... 324/754.07
6,104,167 A 8/2000 Bertness et al. ..... 320/132
6,113,262 A 9/2000 Purola et al. ..... 374/45
6,114,834 A 9/2000 Parise ..... 320/109
6,118,252 A 9/2000 Richter
6,121,880 A 9/2000 Scott et al. ..... 340/572.5
6,136,914 A 10/2000 Hergenrother et al. ..... 524/495
6,137,269 A 10/2000 Champlin ..... 320/150
6,140,797 A 10/2000 Dunn ..... 320/105
6,141,608 A 10/2000 Rother ..... 701/29.6
6,144,185 A 11/2000 Dougherty et al. ..... 320/132
6,147,598 A 11/2000 Murphy et al. ..... 340/426.19
6,149,653 A 11/2000 Deslauriers ..... 606/232
6,150,793 A 11/2000 Lesesky et al. ..... 320/104
6,158,000 A 12/2000 Collins ..... 713/1
6,161,640 A 12/2000 Yamaguchi ..... 180/65.8
6,163,156 A 12/2000 Bertness ..... 324/426
6,164,063 A 12/2000 Mendler ..... 60/274
6,167,349 A 12/2000 Alvarez ..... 702/63
6,172,483 B1 1/2001 Champlin ..... 320/134
6,172,505 B1 1/2001 Bertness ..... 324/430
6,177,737 B1 1/2001 Palfey et al. ..... 307/64
6,181,545 B1 1/2001 Amatucci et al. ..... 361/502
6,184,656 B1 2/2001 Karunasiri et al. ..... 320/119
6,191,557 B1 2/2001 Gray et al. ..... 320/132
6,202,739 B1 3/2001 Pal et al. ..... 165/104.33
6,211,651 B1 4/2001 Nemoto ..... 320/133
6,211,653 B1 4/2001 Stasko ..... 320/132
6,215,275 B1 4/2001 Bean ..... 320/106
6,218,805 B1 4/2001 Melcher ..... 320/105
6,218,936 B1 4/2001 Imao ..... 340/447
6,222,342 B1 4/2001 Eggert et al. ..... 320/105
6,222,369 B1 4/2001 Champlin ..... 324/430
D442,503 S 5/2001 Lundbeck et al. ..... D10/77
6,225,808 B1 5/2001 Varghese et al. ..... 324/426
6,225,898 B1 5/2001 Kamiya et al. ..... 340/505
6,236,186 B1 5/2001 Helton et al. ..... 320/106
6,236,332 B1 5/2001 Conkright et al. ..... 340/3.1
6,236,949 B1 5/2001 Hart ..... 702/64
6,238,253 B1 5/2001 Qualls ..... 439/759
6,242,887 B1 6/2001 Burke ..... 320/104
6,242,921 B1 6/2001 Thibedeau et al. ..... 324/429
6,249,124 B1 6/2001 Bertness ..... 324/426
6,250,973 B1 6/2001 Lowery et al. ..... 439/763
6,252,942 B1 6/2001 Zoiss ..... 379/19
6,254,438 B1 7/2001 Gaunt ..... 439/755
6,255,826 B1 7/2001 Ohsawa ..... 320/116
6,259,170 B1 7/2001 Limoge et al. ..... 307/10.8
6,259,254 B1 7/2001 Klang ..... 324/427
6,262,563 B1 7/2001 Champlin ..... 320/134

(56) References Cited

U.S. PATENT DOCUMENTS 6,262,692 B1 7/2001 Babb ..... 343/895
6,263,268 B1 7/2001 Nathanson ..... 701/29
6,263,322 B1 7/2001 Kirkevold et al. ..... 705/400
6,271,643 B1 8/2001 Becker et al. ..... 320/112
6,271,748 B1 8/2001 Derbyshire et al. ..... 340/442
6,272,387 B1 8/2001 Yoon ..... 700/83
6,275,008 B1 8/2001 Arai et al. ..... 320/132
6,285,191 B1 9/2001 Gollomp et al. ..... 324/427
6,294,896 B1 9/2001 Champlin ..... 320/134
6,294,897 B1 9/2001 Champlin ..... 320/153
6,304,087 B1 10/2001 Bertness ..... 324/426
6,307,349 B1 10/2001 Koenck et al. ..... 320/112
6,310,481 B2 10/2001 Bertness ..... 324/430
6,313,607 B1 11/2001 Champlin ..... 320/132
6,313,608 B1 11/2001 Varghese et al. ..... 320/132
6,316,914 B1 11/2001 Bertness ..... 320/134
6,320,385 B1 11/2001 Ng et al. ..... 320/104
6,323,650 B1 11/2001 Bertness et al. ..... 324/426
6,324,042 B1 11/2001 Andrews ..... 361/93.2
6,329,793 B1 12/2001 Bertness et al. ..... 320/132
6,331,762 B1 12/2001 Bertness ..... 320/134
6,332,113 B1 12/2001 Bertness ..... 702/63
6,346,795 B2 2/2002 Haraguchi et al. ..... 320/136
6,347,958 B1 2/2002 Tsai ..... 439/488
6,351,102 B1 2/2002 Troy ..... 320/139
6,356,042 B1 3/2002 Kahlon et al. ..... 318/138
6,356,083 B1 3/2002 Ying ..... 324/426
6,359,441 B1 3/2002 Bertness ..... 324/426
6,359,442 B1 3/2002 Henningson et al. ..... 324/426
6,363,303 B1 3/2002 Bertness ..... 701/29
RE37,677 E 4/2002 Irie ..... 315/83
6,377,031 B1 4/2002 Karuppana et al. ..... 323/220
6,384,608 B1 5/2002 Namaky ..... 324/430
6,388,448 B1 5/2002 Cervas ..... 324/426
6,389,337 B1 5/2002 Kolls ..... 701/31.6
6,392,414 B2 5/2002 Bertness ..... 324/429
6,396,278 B1 5/2002 Makhija ..... 324/402
6,407,554 B1 6/2002 Godau et al. ..... 324/503
6,411,098 B1 6/2002 Laletin ..... 324/436
6,417,669 B1 7/2002 Champlin ..... 324/426
6,420,852 B1 7/2002 Sato ..... 320/134
6,424,157 B1 7/2002 Gollomp et al. ..... 324/430
6,424,158 B2 7/2002 Klang ..... 324/433
6,433,512 B1 8/2002 Birkler et al. ..... 320/132
6,437,957 B1 8/2002 Karuppana et al. ..... 361/78
6,441,585 B1 8/2002 Bertness ..... 320/132
6,445,158 B1 9/2002 Bertness et al. ..... 320/104
6,448,778 B1 9/2002 Rankin ..... 324/503
6,449,726 B1 9/2002 Smith ..... 713/340
6,456,036 B1 9/2002 Thandiwe ..... 320/106
6,456,045 B1 9/2002 Troy et al. ..... 320/139
6,465,908 B1 10/2002 Karuppana et al. ..... 307/31
6,466,025 B1 10/2002 Klang ..... 324/429
6,466,026 B1 10/2002 Champlin ..... 324/430
6,469,511 B1 10/2002 Vonderhaar et al. ..... 324/425
6,473,659 B1 10/2002 Shah et al. ..... 700/79
6,477,478 B1 11/2002 Jones et al. ..... 702/102
6,495,990 B2 12/2002 Champlin ..... 320/132
6,497,209 B1 12/2002 Karuppana et al. ..... 123/179.3
6,500,025 B1 12/2002 Moenkhaus et al. ..... 439/502
6,501,243 B1 12/2002 Kaneko ..... 318/139
6,505,507 B1 1/2003 Imao ..... 73/146.5
6,507,196 B2 1/2003 Thomsen et al. ..... 324/436
6,526,361 B1 2/2003 Jones et al. ..... 702/63
6,529,723 B1 3/2003 Bentley ..... 455/405
6,531,848 B1 3/2003 Chitsazan et al. ..... 320/153
6,532,425 B1 3/2003 Boost et al. ..... 702/63
6,533,316 B2 3/2003 Breed et al. ..... 280/735
6,534,992 B2 3/2003 Meissner et al. ..... 324/426
6,534,993 B2 3/2003 Bertness ..... 324/433
6,536,536 B1 3/2003 Gass et al. ..... 173/2
6,544,078 B2 4/2003 Palmisano et al. ..... 439/762
6,545,599 B2 4/2003 Derbyshire et al. ..... 340/442
6,556,019 B2 4/2003 Bertness ..... 324/426
6,566,883 B1 5/2003 Vonderhaar et al. ..... 324/426
6,570,385 B1 5/2003 Roberts et al. ..... 324/378
6,577,107 B2 6/2003 Kechmire ..... 320/139
6,586,941 B2 7/2003 Bertness et al. ..... 324/426
6,597,150 B1 7/2003 Bertness et al. ..... 320/104
6,599,243 B2 7/2003 Woltermann et al. ..... 600/300
6,600,815 B1 7/2003 Walding ..... 379/93.07
6,611,740 B2 8/2003 Lowrey et al. ..... 701/29
6,614,349 B1 9/2003 Proctor et al. ..... 340/572.1
6,618,644 B2 9/2003 Bean ..... 700/231
6,621,272 B2 9/2003 Champlin ..... 324/426
6,623,314 B1 9/2003 Cox et al. ..... 439/759
6,624,635 B1 9/2003 Lui ..... 24/426
6,628,011 B2 9/2003 Droppo et al. ..... 307/43
6,629,054 B2 9/2003 Makhija et al. ..... 702/113
6,633,165 B2 10/2003 Bertness ..... 324/426
6,635,974 B1 10/2003 Karuppana et al. ..... 307/140
6,636,790 B1 10/2003 Lightner et al. ..... 701/31.5
6,667,624 B1 12/2003 Raichle et al. ..... 324/522
6,679,212 B2 1/2004 Kelling ..... 123/179.28
6,686,542 B2 2/2004 Zhang ..... 174/74
6,696,819 B2 2/2004 Bertness ..... 320/134
6,707,303 B2 3/2004 Bertness et al. ..... 324/426
6,732,031 B1 5/2004 Lightner et al. ..... 701/31.4
6,736,941 B2 5/2004 Oku et al. ..... 203/68
6,737,831 B2 5/2004 Champlin ..... 320/132
6,738,697 B2 5/2004 Breed ..... 701/29
6,740,990 B2 5/2004 Tozuka et al. ..... 307/9.1
6,744,149 B1 6/2004 Karuppana et al. ..... 307/31
6,745,153 B2 6/2004 White et al. ..... 702/184
6,759,849 B2 7/2004 Bertness ..... 324/426
6,771,073 B2 8/2004 Henningson et al. ..... 324/426
6,777,945 B2 8/2004 Roberts et al. ..... 324/426
6,781,344 B1 8/2004 Hedegor et al. ..... 320/106
6,781,382 B2 8/2004 Johnson ..... 324/426
6,784,635 B2 8/2004 Larson ..... 320/104
6,784,637 B2 8/2004 Raichle et al. ..... 320/107
6,788,025 B2 9/2004 Bertness et al. ..... 320/104
6,795,782 B2 9/2004 Bertness et al. ..... 702/63
6,796,841 B1 9/2004 Cheng et al. ..... 439/620.3
6,805,090 B2 10/2004 Bertness et al. ..... 123/198
6,806,716 B2 10/2004 Bertness et al. ..... 324/426
6,825,669 B2 11/2004 Raichle et al. ..... 324/426
6,832,141 B2 12/2004 Skeen et al. ..... 701/31.4
6,842,707 B2 1/2005 Raichle et al. ..... 702/62
6,845,279 B1 1/2005 Gilmore et al. ..... 700/115
6,850,037 B2 2/2005 Bertness ..... 320/132
6,856,162 B1 2/2005 Greatorex et al. ..... 324/764.01
6,856,972 B1 2/2005 Yun et al. ..... 705/36 R
6,871,151 B2 3/2005 Bertness ..... 702/63
6,885,195 B2 4/2005 Bertness ..... 324/426
6,888,468 B2 5/2005 Bertness ..... 340/636.15
6,891,378 B2 5/2005 Bertness et al. ..... 324/426
6,895,809 B2 5/2005 Raichle ..... 73/119
6,904,796 B2 6/2005 Pacsai et al. ..... 73/146.8
6,906,522 B2 6/2005 Bertness et al. ..... 324/426
6,906,523 B2 6/2005 Bertness et al. ..... 324/426
6,906,624 B2 6/2005 McClelland et al. ..... 340/442
6,909,287 B2 6/2005 Bertness ..... 324/427
6,909,356 B2 6/2005 Brown et al. ..... 340/3.2
6,911,825 B2 6/2005 Namaky ..... 324/426
6,913,483 B2 7/2005 Restaino et al. ..... 439/504
6,914,413 B2 7/2005 Bertness et al. ..... 320/104
6,919,725 B2 7/2005 Bertness et al. ..... 324/433
6,930,485 B2 8/2005 Bertness et al. ..... 324/426
6,933,727 B2 8/2005 Bertness et al. ..... 324/426
6,941,234 B2 9/2005 Bertness et al. ..... 702/63
6,957,133 B1 10/2005 Hunt et al. ..... 701/32.4
6,966,676 B2 11/2005 Chabert et al.
6,967,484 B2 11/2005 Bertness ..... 324/426
6,972,662 B1 12/2005 Ohkawa et al. ..... 340/10.1
6,983,212 B2 1/2006 Burns ..... 702/63
6,988,053 B2 1/2006 Namaky ..... 320/104
6,993,421 B2 1/2006 Pillar et al. ..... 701/29.4
6,998,847 B2 2/2006 Bertness et al. ..... 324/426
7,003,410 B2 2/2006 Bertness et al. ..... 702/63
7,003,411 B2 2/2006 Bertness ..... 702/63
7,012,433 B2 3/2006 Smith et al. ..... 324/426
7,015,674 B2 3/2006 VonderHaar
7,029,338 B1 4/2006 Orange et al. ..... 439/755

(56) References Cited

U.S. PATENT DOCUMENTS 7,034,541 B2 4/2006 Bertness et al. ..... 324/426
7,039,533 B2 5/2006 Bertness et al. ..... 702/63
7,042,346 B2 5/2006 Paulsen ..... 340/438
7,049,822 B2 5/2006 Kung ..... 324/426
7,058,525 B2 6/2006 Bertness et al. ..... 702/63
7,069,979 B2 7/2006 Tobias ..... 165/104.33
7,081,755 B2 7/2006 Klang et al. ..... 324/426
7,089,127 B2 8/2006 Thibedeau et al. ..... 702/63
7,098,666 B2 8/2006 Patino ..... 324/433
7,102,556 B2 9/2006 White ..... 341/141
7,106,070 B2 9/2006 Bertness et al. ..... 324/538
7,116,109 B2 10/2006 Klang ..... 324/426
7,119,686 B2 10/2006 Bertness et al. ..... 340/572.1
7,120,488 B2 10/2006 Nova et al. ..... 600/2
7,126,341 B2 10/2006 Bertness et al. ..... 324/426
7,129,706 B2 10/2006 Kalley ..... 324/426
7,154,276 B2 12/2006 Bertness ..... 324/503
7,170,393 B2 1/2007 Martin ..... 340/10.1
7,173,182 B2 2/2007 Katsuyama ..... 174/36
7,177,925 B2 2/2007 Carcido et al. ..... 709/223
7,182,147 B2 2/2007 Cutler et al. ..... 173/1
7,184,866 B2 2/2007 Squires ..... 340/426.15
7,184,905 B2 2/2007 Stefan ..... 702/63
7,198,510 B2 4/2007 Bertness ..... 439/500
7,200,424 B2 4/2007 Tischer et al. ..... 455/567
7,202,636 B2 4/2007 Reynolds et al. ..... 320/166
7,208,914 B2 4/2007 Klang ..... 320/132
7,209,850 B2 4/2007 Brott et al. ..... 324/426
7,209,860 B2 4/2007 Trsar et al. ..... 702/183
7,212,887 B2 5/2007 Shah et al. ..... 700/276
7,212,911 B2 5/2007 Raichle et al. ..... 701/114
7,219,023 B2 5/2007 Banke et al. ..... 702/58
7,233,128 B2 6/2007 Brost et al. ..... 320/132
7,235,977 B2 6/2007 Koran et al. ..... 324/426
7,246,015 B2 7/2007 Bertness et al. ..... 702/63
7,251,551 B2 7/2007 Mitsueda ..... 700/2
7,272,519 B2 9/2007 Lesesky et al. ..... 702/63
7,287,001 B1 10/2007 Falls et al. ..... 705/22
7,295,936 B2 11/2007 Bertness et al. ..... 702/63
7,301,303 B1 11/2007 Hulden ..... 320/103
7,319,304 B2 1/2008 Veloo et al. ..... 320/134
7,339,477 B2 3/2008 Puzio et al. ..... 340/572.1
7,363,175 B2 4/2008 Bertness et al. ..... 702/63
7,376,497 B2 5/2008 Chen ..... 701/31.6
7,398,176 B2 7/2008 Bertness ..... 702/140
7,408,358 B2 8/2008 Knopf ..... 324/426
7,425,833 B2 9/2008 Bertness et al. ..... 324/426
7,446,536 B2 11/2008 Bertness ..... 324/426
7,453,238 B2 11/2008 Melichar ..... 320/132
7,479,763 B2 1/2009 Bertness ..... 320/134
7,498,767 B2 3/2009 Brown et al. ..... 320/107
7,501,795 B2 3/2009 Bertness et al. ..... 320/134
7,505,856 B2 3/2009 Restaino et al. ..... 702/63
7,538,571 B2 5/2009 Raichle et al. ..... 324/772
7,545,146 B2 6/2009 Klang et al. ..... 324/426
7,557,586 B1 7/2009 Vonderhaar et al. ..... 324/437
7,590,476 B2 9/2009 Shumate ..... 701/31.6
7,592,776 B2 9/2009 Tsukamoto et al. ..... 320/136
7,595,643 B2 9/2009 Klang ..... 324/426
7,598,699 B2 * 10/2009 Restaino ..... G01R 31/3624 320/105
7,598,743 B2 10/2009 Bertness ..... 324/426
7,598,744 B2 10/2009 Bertness et al. ..... 324/426
7,619,417 B2 11/2009 Klang ..... 324/427
7,642,786 B2 1/2010 Philbrook ..... 324/426
7,642,787 B2 1/2010 Bertness et al. ..... 324/426
7,656,162 B2 2/2010 Vonderhaar et al. ..... 324/426
7,657,386 B2 2/2010 Thibedeau et al. ..... 702/63
7,667,437 B2 2/2010 Johnson et al. ..... 320/150
7,679,325 B2 3/2010 Seo ..... 20/116
7,684,908 B1 3/2010 Ogilvie et al. ..... 701/29.6
7,688,074 B2 3/2010 Cox et al. ..... 324/426
7,690,573 B2 4/2010 Raichle et al. ..... 235/462
7,696,759 B2 4/2010 Raichle et al. ..... 324/538
7,698,179 B2 4/2010 Leung et al. ..... 705/28
7,705,602 B2 4/2010 Bertness ..... 324/426
7,706,991 B2 4/2010 Bertness et al. ..... 702/63
7,706,992 B2 4/2010 Ricci et al.
7,710,119 B2 5/2010 Bertness ..... 324/426
7,723,993 B2 5/2010 Klang ..... 324/431
7,728,556 B2 6/2010 Yano et al. ..... 320/134
7,728,597 B2 6/2010 Bertness ..... 324/426
7,729,880 B1 6/2010 Mashburn ..... 702/151
7,743,788 B2 6/2010 Schmitt ..... 137/554
7,751,953 B2 7/2010 Namaky ..... 701/33.2
7,772,850 B2 8/2010 Bertness ..... 324/426
7,774,130 B2 8/2010 Pepper ..... 340/439
7,774,151 B2 8/2010 Bertness ..... 702/63
7,777,612 B2 8/2010 Sampson et al. ..... 340/426.1
7,791,348 B2 9/2010 Brown et al. ..... 324/426
7,808,375 B2 10/2010 Bertness et al. ..... 340/455
7,848,857 B2 12/2010 Nasr et al. ..... 701/22
7,883,002 B2 2/2011 Jin et al. ..... 235/376
7,902,990 B2 3/2011 Delmonico et al. ..... 340/636.1
7,914,350 B1 * 3/2011 Bozich ..... A61B 18/14 439/506
7,924,015 B2 4/2011 Bertness
7,940,052 B2 5/2011 Vonderhaar
7,940,053 B2 5/2011 Brown et al. ..... 324/426
7,959,476 B2 6/2011 Smith et al.
7,977,914 B2 7/2011 Bertness
D643,759 S 8/2011 Bertness
7,990,155 B2 8/2011 Henningson ..... 324/429
7,999,505 B2 8/2011 Bertness ..... 320/104
8,024,083 B2 9/2011 Chenn ..... 701/2
8,047,868 B1 11/2011 Korcynski ..... 439/522
8,164,343 B2 4/2012 Bertness ..... 324/503
8,198,900 B2 6/2012 Bertness et al.
8,203,345 B2 6/2012 Bertness
8,222,868 B2 7/2012 Buckner ..... 320/136
8,226,008 B2 7/2012 Raichle et al. ..... 235/462.13
8,237,448 B2 8/2012 Bertness
8,306,690 B2 11/2012 Bertness ..... 701/34.4
8,310,271 B2 11/2012 Raichle et al. ..... 324/765.01
8,344,685 B2 1/2013 Bertness et al.
8,436,619 B2 5/2013 Bertness et al.
8,442,877 B2 5/2013 Bertness et al.
8,449,560 B2 5/2013 Roth ..... 227/175.1
8,493,022 B2 7/2013 Bertness
D687,727 S 8/2013 Kehoe et al.
8,509,212 B2 8/2013 Sanjeev
8,513,949 B2 8/2013 Bertness
8,594,957 B2 11/2013 Gauthier ..... 324/548
8,674,654 B2 3/2014 Bertness
8,674,711 B2 3/2014 Bertness
8,704,483 B2 4/2014 Bertness et al.
8,738,309 B2 5/2014 Bertness
8,754,653 B2 6/2014 Volderhaar et al.
8,825,272 B1 9/2014 Chinnadurai
8,827,729 B2 9/2014 Gunreben ..... 439/188
8,872,516 B2 10/2014 Bertness
8,872,517 B2 10/2014 Philbrook et al.
8,958,998 B2 2/2015 Bertness
8,963,550 B2 2/2015 Bertness et al.
9,018,958 B2 4/2015 Bertness
9,037,394 B2 5/2015 Fernandes ..... 701/400
9,052,366 B2 6/2015 Bertness
9,201,120 B2 12/2015 Stukenburg
9,229,062 B2 1/2016 Stukenberg
9,244,100 B2 1/2016 Coleman et al.
9,255,955 B2 2/2016 Bertness ..... 324/503
9,274,157 B2 3/2016 Bertness
9,312,575 B2 4/2016 Stukenberg
9,335,362 B2 5/2016 Bertness
9,419,311 B2 8/2016 Bertness
9,425,487 B2 8/2016 Bertness
9,496,720 B2 11/2016 McShane
9,588,185 B2 3/2017 Champlin
9,639,899 B1 5/2017 Gersitz
9,923,289 B2 3/2018 Bertness
9,966,676 B2 5/2018 Salo, III et al.
10,046,649 B2 8/2018 Bertness
2001/0012738 A1 8/2001 Duperret ..... 439/835
2001/0033169 A1 10/2001 Singh ..... 324/426

(56) References Cited

U.S. PATENT DOCUMENTS

2001/0035737 A1 11/2001 Nakanishi et al. ..... 320/122
2001/0048215 A1 12/2001 Breed et al. ..... 280/728.1
2001/0048226 A1 12/2001 Nada ..... 290/40
2002/0003423 A1 1/2002 Bertness et al. ..... 324/426
2002/0004694 A1 1/2002 McLeod ..... 701/29
2002/0007237 A1 1/2002 Phung et al. ..... 701/33
2002/0010558 A1 1/2002 Bertness et al.
2002/0021135 A1 2/2002 Li et al. ..... 324/677
2002/0027346 A1 3/2002 Breed et al. ..... 280/735
2002/0030495 A1 3/2002 Kechmire ..... 324/427
2002/0036504 A1 3/2002 Troy et al. ..... 324/430
2002/0041175 A1 4/2002 Lauper et al. ..... 320/106
2002/0044050 A1 4/2002 Derbyshire et al. ..... 340/442
2002/0047711 A1 4/2002 Bertness et al.
2002/0050163 A1 5/2002 Makhija et al. ..... 73/116
2002/0065619 A1 5/2002 Bertness et al.
2002/0074398 A1 6/2002 Lancos et al. ..... 235/382
2002/0116140 A1 8/2002 Rider ..... 702/63
2002/0118111 A1 8/2002 Brown et al. ..... 340/573.1
2002/0121901 A1 9/2002 Hoffman ..... 324/426
2002/0128985 A1 9/2002 Greenwald ..... 705/400
2002/0130665 A1 9/2002 Bertness et al. ..... 324/426
2002/0153864 A1 10/2002 Bertness ..... 320/132
2002/0171428 A1 11/2002 Bertness ..... 702/63
2002/0176010 A1 11/2002 Wallach et al. ..... 348/362
2002/0193955 A1 12/2002 Bertness ..... 702/63
2003/0006779 A1 1/2003 Youval ..... 324/503
2003/0009270 A1 1/2003 Breed ..... 701/29
2003/0017753 A1 1/2003 Palmisano et al. ..... 439/762
2003/0025481 A1 2/2003 Bertness ..... 324/427
2003/0030442 A1 2/2003 Sugimoto ..... 324/429
2003/0036909 A1 2/2003 Kato ..... 704/275
2003/0040873 A1 2/2003 Lesesky et al. ..... 702/57
2003/0060953 A1 3/2003 Chen ..... 701/33
2003/0078743 A1 4/2003 Bertness et al. ..... 702/63
2003/0088375 A1 5/2003 Bertness et al.
2003/0090272 A1 5/2003 Bertness ..... 324/426
2003/0114206 A1 6/2003 Timothy ..... 455/575.7
2003/0124417 A1 7/2003 Bertness et al. ..... 429/90
2003/0128011 A1 7/2003 Bertness et al.
2003/0128036 A1 7/2003 Henningson et al. ..... 324/426
2003/0137277 A1 7/2003 Mori et al. ..... 320/132
2003/0155930 A1 8/2003 Thomsen
2003/0164073 A1* 9/2003 Chen ..... B25B 7/12
81/342
2003/0169018 A1 9/2003 Berels et al. ..... 320/132
2003/0169019 A1 9/2003 Oosaki ..... 320/132
2003/0171111 A1 9/2003 Clark ..... 455/414.1
2003/0173971 A1 9/2003 Bertness ..... 324/441
2003/0177417 A1 9/2003 Malhotra et al. ..... 714/42
2003/0184262 A1 10/2003 Makhija ..... 320/156
2003/0184264 A1 10/2003 Bertness
2003/0184306 A1 10/2003 Bertness et al. ..... 324/426
2003/0187556 A1 10/2003 Suzuki ..... 701/29
2003/0194672 A1 10/2003 Roberts et al. ..... 431/196
2003/0197512 A1 10/2003 Miller et al. ..... 324/426
2003/0212311 A1 11/2003 Nova et al. ..... 600/300
2003/0214395 A1 11/2003 Flowerday et al. ..... 340/445
2003/0224241 A1 12/2003 Takada et al. ..... 429/52
2003/0236656 A1 12/2003 Dougherty ..... 703/14
2004/0000590 A1 1/2004 Raichle et al. ..... 235/462.01
2004/0000891 A1 1/2004 Raichle et al. ..... 320/107
2004/0000893 A1 1/2004 Raichle et al. ..... 320/135
2004/0000913 A1 1/2004 Raichle et al. ..... 324/426
2004/0000915 A1 1/2004 Raichle et al. ..... 324/522
2004/0002824 A1 1/2004 Raichle et al. ..... 702/63
2004/0002825 A1 1/2004 Raichle et al. ..... 702/63
2004/0002836 A1 1/2004 Raichle et al. ..... 702/188
2004/0032264 A1 2/2004 Schoch ..... 324/426
2004/0036443 A1 2/2004 Bertness ..... 320/109
2004/0044452 A1 3/2004 Bauer et al. ..... 703/33
2004/0044454 A1 3/2004 Ross et al. ..... 701/33
2004/0046564 A1 3/2004 Klang ..... 324/426
2004/0049361 A1 3/2004 Hamdan et al. ..... 702/115
2004/0051532 A1 3/2004 Smith et al. ..... 324/426
2004/0051533 A1 3/2004 Namaky ..... 324/426
2004/0051534 A1 3/2004 Kobayashi et al. ..... 324/429
2004/0054503 A1 3/2004 Namaky ..... 702/182
2004/0064225 A1 4/2004 Jammu et al. ..... 701/29
2004/0065489 A1 4/2004 Aberle ..... 180/65.1
2004/0088087 A1 5/2004 Fukushima et al. ..... 701/32
2004/0104728 A1 6/2004 Bertness et al. ..... 324/429
2004/0108855 A1 6/2004 Raichle ..... 324/378
2004/0108856 A1 6/2004 Johnson ..... 324/426
2004/0113494 A1 6/2004 Karuppana et al.
2004/0113588 A1 6/2004 Mikuriya et al. ..... 320/128
2004/0145342 A1 7/2004 Lyon ..... 320/108
2004/0145371 A1 7/2004 Bertness ..... 324/426
2004/0150494 A1 8/2004 Yoshida ..... 333/243
2004/0157113 A1 8/2004 Klang ..... 429/50
2004/0164706 A1 8/2004 Osborne ..... 320/116
2004/0172177 A1 9/2004 Nagai et al. ..... 701/29
2004/0178185 A1 9/2004 Yoshikawa et al. ..... 219/270
2004/0189309 A1 9/2004 Bertness et al. ..... 324/426
2004/0199343 A1 10/2004 Cardinal et al. ..... 702/63
2004/0207367 A1 10/2004 Taniguchi et al. ..... 320/149
2004/0221641 A1 11/2004 Moritsugu ..... 73/23.31
2004/0227523 A1 11/2004 Namaky ..... 324/537
2004/0239332 A1 12/2004 Mackel et al. ..... 324/426
2004/0251876 A1 12/2004 Bertness et al. ..... 320/136
2004/0251907 A1 12/2004 Kalley
2004/0257084 A1 12/2004 Restaino ..... 324/400
2005/0007068 A1 1/2005 Johnson et al. ..... 320/110
2005/0009122 A1 1/2005 Whelan et al. ..... 435/7.32
2005/0017726 A1 1/2005 Koran et al. ..... 324/433
2005/0017952 A1 1/2005 His ..... 345/169
2005/0021197 A1 1/2005 Zimmerman ..... 701/31.4
2005/0021294 A1 1/2005 Trsar et al. ..... 702/183
2005/0021475 A1 1/2005 Bertness ..... 705/63
2005/0025299 A1 2/2005 Tischer et al. ..... 379/199
2005/0035752 A1 2/2005 Bertness
2005/0043868 A1 2/2005 Mitcham ..... 701/29
2005/0057256 A1 3/2005 Bertness ..... 324/426
2005/0060070 A1 3/2005 Kapolka et al. ..... 701/29
2005/0073314 A1 4/2005 Bertness et al. ..... 324/433
2005/0076381 A1 4/2005 Gross ..... 725/107
2005/0077904 A1 4/2005 Bertness
2005/0096809 A1 5/2005 Skeen et al. ..... 701/29
2005/0102073 A1 5/2005 Ingram ..... 701/29
2005/0119809 A1 6/2005 Chen ..... 701/33.5
2005/0128083 A1 6/2005 Puzio et al. ..... 340/572.1
2005/0128902 A1 6/2005 Tsai ..... 369/44.32
2005/0133245 A1 6/2005 Katsuyama ..... 174/74 R
2005/0134282 A1 6/2005 Averbuch ..... 324/426
2005/0143882 A1 6/2005 Umezawa ..... 701/29
2005/0159847 A1 7/2005 Shah et al. ..... 700/276
2005/0162172 A1 7/2005 Bertness ..... 324/426
2005/0168226 A1 8/2005 Quint et al. ..... 324/426
2005/0173142 A1 8/2005 Cutler et al. ..... 173/181
2005/0182536 A1 8/2005 Doyle et al. ..... 701/29
2005/0184732 A1 8/2005 Restaino ..... 324/426
2005/0206346 A1 9/2005 Smith et al.
2005/0212521 A1 9/2005 Bertness et al. ..... 324/426
2005/0213874 A1 9/2005 Kline ..... 385/15
2005/0218902 A1 10/2005 Restaino et al. ..... 324/433
2005/0231205 A1 10/2005 Bertness et al. ..... 324/426
2005/0254106 A9 11/2005 Silverbrook et al. ..... 358/539
2005/0256617 A1 11/2005 Cawthorne et al. ..... 701/22
2005/0258241 A1 11/2005 McNutt et al. ..... 235/385
2005/0264296 A1 12/2005 Philbrook ..... 324/433
2005/0269880 A1 12/2005 Konishi ..... 307/10.7
2005/0273218 A1 12/2005 Breed ..... 701/2
2006/0012330 A1 1/2006 Okumura et al. ..... 320/103
2006/0017447 A1 1/2006 Bertness ..... 324/538
2006/0026017 A1 2/2006 Walker ..... 701/31.4
2006/0030980 A1 2/2006 St Denis ..... 701/29
2006/0038572 A1 2/2006 Philbrook
2006/0043976 A1 3/2006 Gervais ..... 324/508
2006/0061469 A1 3/2006 Jaeger ..... 340/539.13
2006/0076923 A1 4/2006 Eaves ..... 320/112
2006/0079203 A1 4/2006 Nicolini ..... 455/411
2006/0089767 A1 4/2006 Sowa ..... 701/29
2006/0090554 A1 5/2006 Krampitz
2006/0090555 A1 5/2006 Krampitz

(56) References Cited

U.S. PATENT DOCUMENTS

2006/0091597 A1 5/2006 Opsahl
2006/0092584 A1 5/2006 Raichle
2006/0095230 A1 5/2006 Grier et al. ..... 702/183
2006/0102397 A1 5/2006 Buck ..... 429/432
2006/0125482 A1 6/2006 Klang
2006/0136119 A1 6/2006 Raichle
2006/0139167 A1 6/2006 Davie
2006/0152224 A1 7/2006 Kim et al. ..... 324/430
2006/0155439 A1 7/2006 Slawinski ..... 701/33.4
2006/0161313 A1 7/2006 Rogers et al. ..... 701/1
2006/0161390 A1 7/2006 Namaky et al. ..... 702/183
2006/0217914 A1 9/2006 Bertness ..... 702/113
2006/0244457 A1* 11/2006 Henningson ..... G01R 31/006 324/426
2006/0282227 A1 12/2006 Bertness
2006/0282323 A1 12/2006 Walker et al. ..... 705/14
2007/0005201 A1 1/2007 Chenn ..... 701/31.5
2007/0024460 A1 2/2007 Clark ..... 340/663
2007/0026916 A1 2/2007 Juds et al. ..... 463/1
2007/0046261 A1 3/2007 Porebski ..... 320/132
2007/0082652 A1 4/2007 Hartigan
2007/0088472 A1 4/2007 Ganzhorn et al. ..... 701/33
2007/0108942 A1 5/2007 Johnson et al. ..... 320/112
2007/0159177 A1 7/2007 Bertness et al. ..... 324/426
2007/0182576 A1 8/2007 Proska et al. ..... 340/636.1
2007/0194791 A1 8/2007 Huang ..... 324/430
2007/0194793 A1 8/2007 Bertness ..... 324/503
2007/0205752 A1 9/2007 Leigh ..... 324/500
2007/0205983 A1 9/2007 Naimo ..... 345/160
2007/0210801 A1 9/2007 Krampitz ..... 324/426
2007/0244660 A1 10/2007 Bertness
2007/0259256 A1 11/2007 Le Canut et al. ..... 429/90
2007/0279066 A1 12/2007 Chism ..... 324/437
2008/0023547 A1 1/2008 Raichle ..... 235/462.13
2008/0003857 A1 2/2008 Seo et al. ..... 320/132
2008/0036421 A1 2/2008 Seo ..... 320/132
2008/0053716 A1 3/2008 Scheucher ..... 180/2.1
2008/0059014 A1 3/2008 Nasr et al. ..... 701/22
2008/0064559 A1 3/2008 Cawthorne ..... 477/5
2008/0086246 A1 4/2008 Bolt et al. ..... 701/29
2008/0094068 A1 4/2008 Scott ..... 324/426
2008/0103656 A1 5/2008 Lipscomb ..... 701/33.4
2008/0106267 A1 5/2008 Bertness ..... 320/112
2008/0169818 A1 7/2008 Lesesky et al. ..... 324/426
2008/0179122 A1 7/2008 Sugawara ..... 180/65.245
2008/0194984 A1 8/2008 Keefe ..... 600/559
2008/0303528 A1 12/2008 Kim ..... 324/430
2008/0303529 A1 12/2008 Nakamura et al. ..... 324/433
2008/0315830 A1 12/2008 Bertness ..... 320/104
2009/0006476 A1 1/2009 Andreasen et al. ..... 707/104.1
2009/0011327 A1 1/2009 Okumura et al. ..... 429/99
2009/0013521 A1 1/2009 Okumura et al. ..... 29/730
2009/0024266 A1 1/2009 Bertness ..... 701/22
2009/0024419 A1 1/2009 McClellan ..... 705/4
2009/0085571 A1 4/2009 Bertness ..... 324/426
2009/0146800 A1 6/2009 Grimlund et al. ..... 340/505
2009/0184165 A1 7/2009 Bertness et al.
2009/0198372 A1 8/2009 Hammerslag ..... 700/226
2009/0203247 A1 8/2009 Fifelski ..... 439/345
2009/0237029 A1 9/2009 Andelfinger ..... 320/108
2009/0237086 A1 9/2009 Andelfinger ..... 324/431
2009/0247020 A1 10/2009 Gathman et al. ..... 439/759
2009/0259432 A1 10/2009 Liberty ..... 702/150
2009/0265121 A1 10/2009 Rocci ..... 702/57
2009/0276115 A1 11/2009 Chen ..... 701/32
2009/0311919 A1 12/2009 Smith et al. ..... 439/759
2010/0023198 A1 1/2010 Hamilton ..... 701/29
2010/0039065 A1 2/2010 Kinkade ..... 320/104
2010/0052193 A1 3/2010 Sylvester ..... 261/26
2010/0066283 A1 3/2010 Kitanaka ..... 318/400.02
2010/0094496 A1 4/2010 Hershkovitz et al.
2010/0117603 A1 5/2010 Makhija ..... 320/162
2010/0145780 A1 6/2010 Nishikawa et al. ..... 705/14.11
2010/0214055 A1 8/2010 Fuji ..... 340/3.1
2010/0265131 A1 10/2010 Fabius
2010/0314950 A1 12/2010 Rutkowski et al. ..... 307/125
2011/0004427 A1 1/2011 Gorbold et al. ..... 702/63
2011/0015815 A1 1/2011 Bertness ..... 701/22
2011/0106280 A1 5/2011 Zeier ..... 700/90
2011/0161025 A1 6/2011 Tomura ..... 702/63
2011/0215767 A1 9/2011 Johnson et al. ..... 320/136
2011/0218747 A1 9/2011 Bertness ..... 702/63
2011/0265025 A1 10/2011 Bertness
2011/0267067 A1 11/2011 Bertness et al.
2011/0273181 A1 11/2011 Park et al. ..... 324/429
2011/0294367 A1 12/2011 Moon ..... 439/878
2011/0300416 A1 12/2011 Bertness
2012/0041697 A1 2/2012 Stukenberg ..... 702/63
2012/0046807 A1 2/2012 Ruther ..... 701/2
2012/0046824 A1 2/2012 Ruther et al. ..... 701/31.5
2012/0062237 A1 3/2012 Robinson ..... 324/433
2012/0074904 A1 3/2012 Rutkowski et al. ..... 320/112
2012/0086399 A1 4/2012 Choi
2012/0116391 A1 5/2012 Houser ..... 606/41
2012/0182132 A1 7/2012 McShane
2012/0249069 A1 10/2012 Ohtomo ..... 320/109
2012/0256494 A1 10/2012 Kesler ..... 307/104
2012/0256568 A1 10/2012 Lee ..... 318/139
2012/0293372 A1 11/2012 Amendolare ..... 342/451
2013/0106362 A1 5/2013 Mackintosh et al.
2013/0115821 A1 5/2013 Golko ..... 439/638
2013/0158782 A1 6/2013 Bertness et al. ..... 701/34.4
2013/0172019 A1 7/2013 Youssef ..... 455/456.6
2013/0218781 A1 8/2013 Simon
2013/0288706 A1 10/2013 Yu ..... 455/456.1
2013/0297247 A1 11/2013 Jardine
2013/0311124 A1 11/2013 Van Bremen
2013/0314041 A1 11/2013 Proebstle ..... 320/109
2013/0325405 A1 12/2013 Miller
2014/0002021 A1 1/2014 Bertness
2014/0002094 A1 1/2014 Champlin ..... 324/426
2014/0081527 A1 3/2014 Miller
2014/0099830 A1 4/2014 Byrne ..... 439/638
2014/0117997 A1 5/2014 Bertness
2014/0194084 A1 7/2014 Noonan ..... 455/404.1
2014/0260577 A1 9/2014 Chinnadurai
2014/0266061 A1 9/2014 Wachal
2014/0278159 A1 9/2014 Chinnadurai
2014/0354237 A1 12/2014 Cotton
2015/0093922 A1 4/2015 Bosscher ..... 439/39
2015/0166518 A1 6/2015 Boral et al.
2015/0168499 A1 6/2015 Palmisano
2015/0221135 A1 8/2015 Hill ..... 345/633
2016/0011271 A1 1/2016 Bertness
2016/0091571 A1 3/2016 Salo, III
2016/0154044 A1 6/2016 Bertness
2016/0171799 A1 6/2016 Bertness
2016/0216335 A1 7/2016 Bertness
2016/0238667 A1 8/2016 Palmisano et al.
2016/0253852 A1 9/2016 Bertness et al.
2016/0266212 A1 9/2016 Carlo
2016/0285284 A1 9/2016 Matlapudi et al.
2016/0321897 A1 11/2016 Lee
2017/0093056 A1 3/2017 Salo, III et al.
2017/0146602 A1 5/2017 Samp
2017/0373410 A1 12/2017 Lipkin et al.
2018/0009328 A1 1/2018 Hinterberger et al.
2018/0113171 A1 4/2018 Bertness
2018/0306867 A1 10/2018 Bertness

FOREIGN PATENT DOCUMENTS

CN 103091633 5/2013
CN 206658084 11/2017
DE 29 26 716 B1 1/1981
DE 40 07 883 9/1991
DE 196 38 324 9/1996
DE 10 2008 036 595 A1 2/2010
EP 0 022 450 A1 1/1981
EP 0 391 694 A2 4/1990
EP 0 476 405 A1 9/1991
EP 0 637 754 A1 2/1995
EP 0 772 056 A1 5/1997
EP 0 982 159 A2 3/2000

(56) References Cited

FOREIGN PATENT DOCUMENTS

| | | | |
|---|---|---|---|
| EP | 1 810 869 | A1 | 11/2004 |
| EP | 1 786 057 | | 5/2007 |
| EP | 1 807 710 | B1 | 7/2007 |
| EP | 1 807 710 | | 1/2010 |
| EP | 2 302 724 | | 3/2011 |
| FR | 2 749 397 | | 12/1997 |
| GB | 154 016 | | 11/1920 |
| GB | 2 029 586 | | 3/1980 |
| GB | 2 088 159 | A | 6/1982 |
| GB | 2 246 916 | A | 10/1990 |
| GB | 2 275 783 | A | 7/1994 |
| GB | 2 353 367 | | 2/2001 |
| GB | 2 387 235 | A | 10/2003 |
| JP | 59-17892 | | 1/1984 |
| JP | 59-17893 | | 1/1984 |
| JP | 59017894 | | 1/1984 |
| JP | 59215674 | | 12/1984 |
| JP | 60225078 | | 11/1985 |
| JP | 62-180284 | | 8/1987 |
| JP | 63027776 | | 2/1988 |
| JP | 03274479 | | 12/1991 |
| JP | 03282276 | | 12/1991 |
| JP | 4-8636 | | 1/1992 |
| JP | 04095788 | | 3/1992 |
| JP | 04131779 | | 5/1992 |
| JP | 04372536 | | 12/1992 |
| JP | 05211724 | A | 8/1993 |
| JP | 5216550 | | 8/1993 |
| JP | 7-128414 | | 5/1995 |
| JP | 09061505 | | 3/1997 |
| JP | 10056744 | | 2/1998 |
| JP | 10232273 | | 9/1998 |
| JP | 11103503 | A | 4/1999 |
| JP | 11-150809 | | 6/1999 |
| JP | 11-271409 | | 10/1999 |
| JP | 2001-023037 | | 1/2001 |
| JP | 2001057711 | A | 2/2001 |
| JP | 2003-346909 | | 12/2003 |
| JP | 2005-238969 | | 9/2005 |
| JP | 2006331976 | A | 12/2006 |
| JP | 2009-244166 | | 10/2009 |
| JP | 2009-261174 | | 11/2009 |
| JP | 2010-172122 | | 5/2010 |
| JP | 2010-172142 | | 8/2010 |
| RU | 2089015 | C1 | 8/1997 |
| WO | WO 93/22666 | | 11/1993 |
| WO | WO 94/05069 | | 3/1994 |
| WO | WO 96/01456 | | 1/1996 |
| WO | WO 96/06747 | | 3/1996 |
| WO | WO 96/28846 | | 9/1996 |
| WO | WO 97/01103 | | 1/1997 |
| WO | WO 97/44652 | | 11/1997 |
| WO | WO 98/04910 | | 2/1998 |
| WO | WO 98/21132 | | 5/1998 |
| WO | WO 98/58270 | | 12/1998 |
| WO | WO 99/23738 | | 5/1999 |
| WO | WO 99/56121 | | 11/1999 |
| WO | WO 00/16083 | | 3/2000 |
| WO | WO 00/62049 | | 10/2000 |
| WO | WO 00/67359 | | 11/2000 |
| WO | WO 01/59443 | | 2/2001 |
| WO | WO 01/16614 | | 3/2001 |
| WO | WO 01/16615 | | 3/2001 |
| WO | WO 01/51947 | | 7/2001 |
| WO | WO 03/047064 | A3 | 6/2003 |
| WO | WO 03/076960 | A1 | 9/2003 |
| WO | WO 2004/047215 | A1 | 6/2004 |
| WO | WO 2007/075403 | | 7/2007 |
| WO | WO 2009/004001 | | 1/2009 |
| WO | WO 2010/007681 | | 1/2010 |
| WO | WO 2010/035605 | | 4/2010 |
| WO | WO 2010/042517 | | 4/2010 |
| WO | WO 2011/153419 | | 12/2011 |
| WO | WO 2012/078921 | | 6/2012 |
| WO | WO 2013/070850 | | 5/2013 |

OTHER PUBLICATIONS

"Battery Impedance", by E. Willihnganz et al., *Electrical Engineering*, Sep. 1959, pp. 922-925.

"Determining The End of Battery Life", by S. DeBardelaben, *IEEE*, 1986, pp. 365-368.

"A Look at the Impedance of a Cell", by S. Debardelaben, *IEEE*, 1988, pp. 394-397.

"The Impedance of Electrical Storage Cells", by N.A. Hampson et al., *Journal of Applied Electrochemistry*, 1980, pp. 3-11.

"A Package for Impedance/Admittance Data Analysis", by B. Boukamp, *Solid State Ionics*, 1986, pp. 136-140.

"Precision of Impedance Spectroscopy Estimates of Bulk, Reaction Rate, and Diffusion Parameters", by J. Macdonald et al., *J. Electroanal, Chem.*, and 1991, pp. 1-11.

Internal Resistance: Harbinger of Capacity Loss in Starved Electrolyte Sealed Lead Acid Batteries, by Vaccaro, F.J. et al., *AT&T Bell Laboratories*, 1987 IEEE, Ch. 2477, pp. 128,131.

IEEE Recommended Practice For Maintenance, Testings, and Replacement of Large Lead Storage Batteries for Generating Stations and Substations, *The Institute of Electrical and Electronics Engineers, Inc., ANSI/IEEE Std*. 450-1987, Mar. 9, 1987, pp. 7-15.

"Field and Laboratory Studies to Assess the State of Health of Valve-Regulated Lead Acid Batteries: Part I Conductance/Capacity Correlation Studies", by D. Feder et al., *IEEE*, Aug. 1992, pp. 218-233.

"JIS Japanese Industrial Standard-Lead Acid Batteries for Automobiles", *Japanese Standards Association UDC*, 621.355.2:629.113.006, Nov. 1995.

"Performance of Dry Cells", by C. Hambuechen, Preprint of *Am. Electrochem. Soc.*, Apr. 18-20, 1912, paper No. 19, pp. 1-5.

"A Bridge for Measuring Storage Battery Resistance", by E. Willihncanz, *The Electrochemical Society*, preprint 79-20, Apr. 1941, pp. 253-258.

National Semiconductor Corporation, "High Q Notch Filter", 3/69, Linear Brief 5, Mar. 1969.

Burr-Brown Corporation, "Design A 60 Hz Notch Filter with the UAF42", 1/94, AB-071, 1994.

National Semiconductor Corporation, "LMF90-4$^{th}$-Order Elliptic Notch Filter", 12/94, RRD-B30M115, Dec. 1994.

"Alligator Clips with Wire Penetrators" *J.S. Popper, Inc.* product information, downloaded from http://www.jspopper.com/, prior to Oct. 1, 2002.

"#12: LM78S40 Simple Switcher DC to DC Converter", *ITM e-Catalog*, downloaded from http://www.pcbcafe.com, prior to Oct. 1, 2002.

"Simple DC-DC Converts Allows Use of Single Battery", *Electronix Express*, downloaded from http://www.elexp.com/t_dc-dc.htm, prior to Oct. 1, 2002.

"DC-DC Converter Basics", *Power Designers*, downloaded from http://www.powerdesigners.com/InforWeb.design_center/articles/DC-DC/converter.shtm, prior to Oct. 1, 2002.

"Notification of Transmittal of The International Search Report or the Declaration", PCT/US02/29461, filed Sep. 17, 2002 and dated Jan. 3, 2003.

"Notification of Transmittal of The International Search Report or the Declaration", PCT/US03/07546, filed Mar. 13, 2003 and dated Jul. 4, 2001.

"Notification of Transmittal of The International Search Report or the Declaration", PCT/US03/06577, filed Mar. 5, 2003 and dated Jul. 24, 2003.

"Notification of Transmittal of The International Search Report or the Declaration", PCT/US03/07837, filed Mar. 14, 2003 and dated Jul. 4, 2003.

"Improved Impedance Spectroscopy Technique For Status Determination of Production Li/$SO_2$ Batteries" Terrill Atwater et al., pp. 10-113, (1992).

"Notification of Transmittal of The International Search Report or the Declaration", PCT/US03/41561; Search Report completed Apr. 13, 2004, dated May 6, 2004.

"Notification of Transmittal of The International Search Report or the Declaration", PCT/US03/27696, filed Sep. 4, 2003 and dated Apr. 15, 2004.

(56) References Cited

OTHER PUBLICATIONS

"Programming Training Course, 62-000 Series Smart Engine Analyzer", Testproducts Division, Kalamazoo, Michigan, pp. 1-207, (1984).
"Operators Manual, Modular Computer Analyzer Model MCA 3000", Sun Electric Corporation, Crystal Lake, Illinois, pp. 1-1-14-13, (1991).
Supplementary European Search Report Communication for Appl. No. 99917402.2; dated Sep. 7, 2004.
"Dynamic modelling of lead/acid batteries using impedance spectroscopy for parameter identification", Journal of Power Sources, pp. 69-84, (1997).
Notification of Transmittal of the International Search Report for PCT/US03/30707, filed Sep. 30, 2003 and dated Nov. 24, 2004.
"A review of impedance measurements for determination of the state-of-charge or state-of-health of secondary batteries", Journal of Power Sources, pp. 59-69, (1998).
"Search Report Under Section 17" for Great Britain Application No. GB0421447.4, date of search Jan. 27, 2005, dated Jan. 28, 2005.
"Results of Discrete Frequency Immittance Spectroscopy (DFIS) Measurements of Lead Acid Batteries", by K.S. Champlin et al., *Proceedings of 23rd International Teleco Conference* (*INTELEC*), published Oct. 2001, IEE, pp. 433-440.
"Examination Report" from the UK Patent Office for App. No. 0417678.0; dated Jan. 24, 2005.
Wikipedia Online Encyclopedia, INDUCTANCE, 2005, http://en.wikipedia.org/wiki/inductance, pp. 1-5, mutual inductance, pp. 3,4.
"Professional BCS System Analyzer Battery-Charger-Starting", pp. 2-8, (2001).
Young Illustrated Encyclopedia Dictionary of Electronics, 1981, Parker Publishing Company, Inc., pp. 318-319.
"DSP Applications in Hybrid Electric Vehicle Powertrain", Miller et al., Proceedings of the American Control Conference, San Diego, CA, Jun. 1999; 2 ppg.
"Notification of Transmittal of the International Search Report and the Written Opinion of the International Searching Authority, or the Declaration" for PCT/US2008/008702 filed Jul. 2008; 15 pages.
"A Microprocessor-Based Control System for a Near-Term Electric Vehicle", Bimal K. Bose; IEEE Transactions on Industry Applications, vol. IA-17, No. 6, Nov./Dec. 1981; 0093-9994/81/1100-0626$00.75 © 1981 IEEE, 6 pages.
Notification of Transmittal of the International Search Report and the Written Opinion of the International Searching Authority, or the Declaration for PCT/US2011/038279 filed May 27, 2011, dated Sep. 16, 2011, 12 pages.
Provisional U.S. Appl. No. 60/387,912, filed Jun. 13, 2002 which is related to U.S. Pat. No. 7,089,127.
"Conductance Testing Compared to Traditional Methods of Evaluating the Capacity of Valve-Regulated Lead-Acid Batteries and Predicting State-of-Health", by D. Feder et al., May 1992, pp. 1-8; (13 total pgs.).
"Field and Laboratory Studies to Assess the State of Health of Valve-Regulated Lead Acid Batteries: Part I—Conductance/Capacity Correlation Studies", by D. Feder at al., Oct. 1992, pp. 1-15; (19 total pgs.).
"Field Application of Conductance Measurements Use to Ascertain Cell/Battery and Inter-Cell Connection State-of-Health in Electric Power Utility Applications", by M. Hlavac et al., Apr. 1993, pp. 1-14; (19 total pgs.).
"Conductance Testing of Standby Batteries in Signaling and Communications Applications for the Purpose of Evaluating Battery State-of-Health", by S. McShane, Apr. 1993, pp. 1-9; (14 total pgs.).
"Condutance Monitoring of Recombination Lead Acid Batteries", by B. Jones, May 1993, pp. 1-6; (11 total pgs.).
"Evaluating the State-of-Health of Lead Acid Flooded and Valve-Regulated Batteries: A Comparison of Conductance Testing vs. Traditional Methods", by M. Hlavac et al., Jun. 1993, pp. 1-15; (20 total pgs.).
"Updated State of Conductance/Capacity Correlation Studies to Determine the State-of-Health of Automotive SLI and Standby Lead Acid Batteries", by D. Feder et al., Sep. 1993, pp. 1-17; (22 total pgs.).
"Field and Laboratory Studies to Access the State-of-Health of Valve-Regulated Lead-Acid Battery Technologies Using Conductance Testing Part II—Further Conductance/Capacity Correlation Studies", by M. Hlavac et al., Sep. 1993, pp. 1-9; (14 total pgs.).
"Field Experience of Testing VRLA Batteries by Measuring Conductance", by M.W. Kniveton, May 1994, pp. 1-4; (9 total pgs.).
"Reducing the Cost of Maintaining VRLA Batteries in Telecom Applications", by M.W. Kniveton, Sep. 1994, pp. 1-5; (10 total pgs.).
"Analysis and Interpretation of Conductance Measurements used to Access the State-of-Health of Valve Regulated Lead Acid Batteries Part III: Analytical Techniques", by M. Hlavac, Nov. 1994, 9 pgs; (13 total pgs.).
"Testing 24 Volt Aircraft Batteries Using Midtronics Conductance Technology", by M. Hlavac et al., Jan. 1995, 9 pgs; (13 total pgs.).
"VRLA Battery Monitoring Using Conductance Technology Part IV: On-Line State-of-Health Monitoring and Thermal Runaway Detection/Prevention", by M. Hlavac et al., Oct. 1995, 9 pgs; (13 total pgs.).
"VRLA Battery Conductance Monitoring Part V: Strategies for VRLA Battery Testing and Monitoring in Telecom Operating Environments", by M. Hlavac et al., Oct. 1996, 9 pgs; (13 total pgs.).
"Midpoint Conductance Technology Used In Telecommunication Stationary Standby Battery Applications Part VI: Considerations for Deployment of Midpoint Conductance in Telecommunications Power Applications", by M. Troy et al., Oct. 1997, 9 pgs; (13 total pgs.).
"Impedance/Conductance Measurements as an Aid to Determining Replacement Strategies", M. Kniveton, Sep. 1998, pp. 297-301; (9 total pgs.).
"A Fundamentally New Approach to Battery Performance Analysis Using DFRA™/DTIS™ Technology", by K. Champlin et al., Sep. 2000, 8 pgs; (12 total pgs.).
"Battery State of Health Monitoring, Combining Conductance Technology With Other Measurement Parameters for Real-Time Battery Performance Analysis", by D. Cox et al., Mar. 2000, 6 pgs; (10 total pgs.).
Search Report and Written Opinion from PCT Application No. PCT/US2011/026608, dated Aug. 29, 2011, 9 pgs.
Examination Report under section 18(3) for corresponding Great Britain Application No. GB1000773.0, dated Feb. 6, 2012, 2 pages.
Communication from GB1216105.5, dated Sep. 21, 2012.
Notification of Transmittal of the International Search Report and Written Opinion from PCT/US2011/039043, dated Jul. 26, 2012.
Notification of Transmittal of the International Search Report and Written Opinion from PCT/US2011/053886, dated Jul. 27, 2012.
"Field Evaluation of Honda's EV PLUS Battery Packs", by A. Paryani, *IEEE AES Systems Magazine*, Nov. 2000, pp. 21-24.
Search Report from PCT/US2011/047334, dated Nov. 11, 2011.
Written Opinion from PCT/US2011/047354, dated Nov. 11, 2011.
First Office Action (Notification of Reasons for Rejections) dated Dec. 3, 2013 in related Japanese patent application No. 2013-513370, 9 pgs. Including English Translation.
Official Action dated Jan. 22, 2014 in Korean patent application No. 10-2012-7033020, 2 pgs including English Translation.
Official Action dated Feb. 20, 2014 in Korean patent application No. 10-2013-7004814, 6 pgs including English Translation.
First Office Action for Chinese Patent Application No. 201180011597.4, dated May 6, 2014, 20 pages.
Office Action from Korean Application No. 10-2012-7033020, dated Jul. 29, 2014.
Office Action for Chinese Patent Application No. 201180038844.X, dated Jul. 1, 2014.
Office Action for Chinese Patent Application No. 201180030045.8, dated Jul. 21, 2014.
Office Action for German Patent Application No. 1120111020643 dated Aug. 28, 2014.
Office Action from Japanese Patent Application No. 2013-513370, dated Aug. 5, 2014.

(56) References Cited

OTHER PUBLICATIONS

Office Action from Japanese Patent Application No. 2013-531839, dated Jul. 8, 2014.
Office Action for German Patent Application No. 103 32 625.1, dated Nov. 7, 2014, 14 pages.
Office Action from Chinese Patent Application No. 201180038844.X, dated Dec. 8, 2014.
Office Action from CN Application No. 201180011597.4, dated Jan. 6, 2015.
Office Action for Chinese Patent Application No. 201180030045.8, dated Mar. 24, 2015.
Office Action for Japanese Patent Application No. 2013-531839, dated Mar. 31, 2015.
Notification of Transmittal of the International Search Report and Written Opinion from PCT/US2014/069661, dated Mar. 26, 2015.
Office Action for Chinese Patent Application No. 201180038844.X, dated Jun. 8, 2015.
Office Action from Chinese Patent Application No. 201180011597.4 dated Jun. 3, 2015.
European Search Report from European Application No. EP 15151426.2, dated Jun. 1, 2015.
Notification of Transmittal of the International Search Report and the Written Opinion from PCT/US2016/014867, dated Jun. 3, 2016.
Office Action from Japanese Patent Application No. 2015-014002, dated Jul. 19, 2016.
Notification of Transmittal of the International Search Report and the Written Opinion of the International Searching Authority from PCT/US2016/02696, dated Aug. 24, 2016.
Office Action from German Patent Application No. 10393251.8, dated Nov. 4, 2016, including English translation.
Office Action from European Patent Application No. 15 151 426.2-1801, dated Aug. 28, 2017, 2 pages.
Office Action from German Patent Application No. 112011101892.4, dated Sep. 7, 2017.
Office Action from Japanese Patent Application No. 2017-026740, dated Jan. 9, 2018.
Office Action from Chinese Patent Application No. 201480066251.8, dated May 29, 2018.
Brochure: "Sensors Intelligent Battery Sensors, Measuring Battery Capacity and Ageing", by Hella, 6 pgs.
Office Action from Japanese Patent Application No. 2017-026740, dated May 8, 2018.
U.S. Appl. No. 12/697,485, filed Feb. 1, 2010, 36 pgs.
Office Action from Chinese Patent Application No. 201480066251.8, dated Dec. 13, 2018.
Notification of Transmittal of the International Search Report and the Written Opinion of the International Searching Authority, or the Declaration for PCT/US2019/014487, dated Apr. 11, 2019.
Notification of Transmittal of the International Search Report and the Written Opinion of the International Searching Authority, or the Declaration for PCT/US2019/014494, dated Apr. 24, 2019.

* cited by examiner

BATTERY CLAMP

CROSS-REFERENCE TO RELATED APPLICATION

The present application is based on and claims the benefit of U.S. provisional patent application Ser. No. 62/355,465, filed Jun. 28, 2016, the content of which is hereby incorporated by reference in its entirety.

Embodiments of the present disclosure generally relate to clamps for electrically coupling to storage batteries.

Battery clamps are typically used to electrically couple cables to the terminals of storage batteries. For example, battery clamps may be used to connect jumper cables or battery charger cables to the terminals of a storage battery.

Conventional battery clamps, such as the clamp 500 shown in the side plan view of FIG. 5, and that disclosed in U.S. Published Application No. 2015/0200470, which is incorporated herein by reference in its entirety, include arms 502 and 504 that are pivotably connected to each other at a single pivotable connection 506 that is formed between the arms 502 and 504. The single pivotable connection defines a single axis of rotation 510 about which the arms 502 and 504 pivot or rotate relative to each other. Handle sections 508 of the arms 502 and 504 may be squeezed by a user to pivot the arms 502 and 504 about the axis 510 of the pivotable connection 506 to transition jaw sections 512 of the arms 502 and 504 to an open position, which is shown in FIG. 5. The user can release the handle sections 508 to pivot the arms 502 and 504 about the axis 510, and transition the jaw sections 512 to a closed or gripping position to connect to a terminal of a battery, for example.

SUMMARY

Embodiments of the present disclosure are directed to a clamp for providing an electrical connection, such as an electrical connection to a battery. In some embodiments, the clamp includes a first arm, a second arm, a joint member, a first pivotable connection, and a second pivotable connection. The first arm includes a proximal end, a distal end, and an electrically conductive member at the distal end. The second arm includes a proximal end and a distal end. The first pivotable connection is between the joint member and the first arm, and defines a first axis about which the first arm is configured to rotate relative to the joint member. The second pivotable connection is between the joint member and the second arm, and defines a second axis about which the second arm is configured to rotate relative to the joint member. The first and second axes are displaced from each other in a direction that is perpendicular to the first axis.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
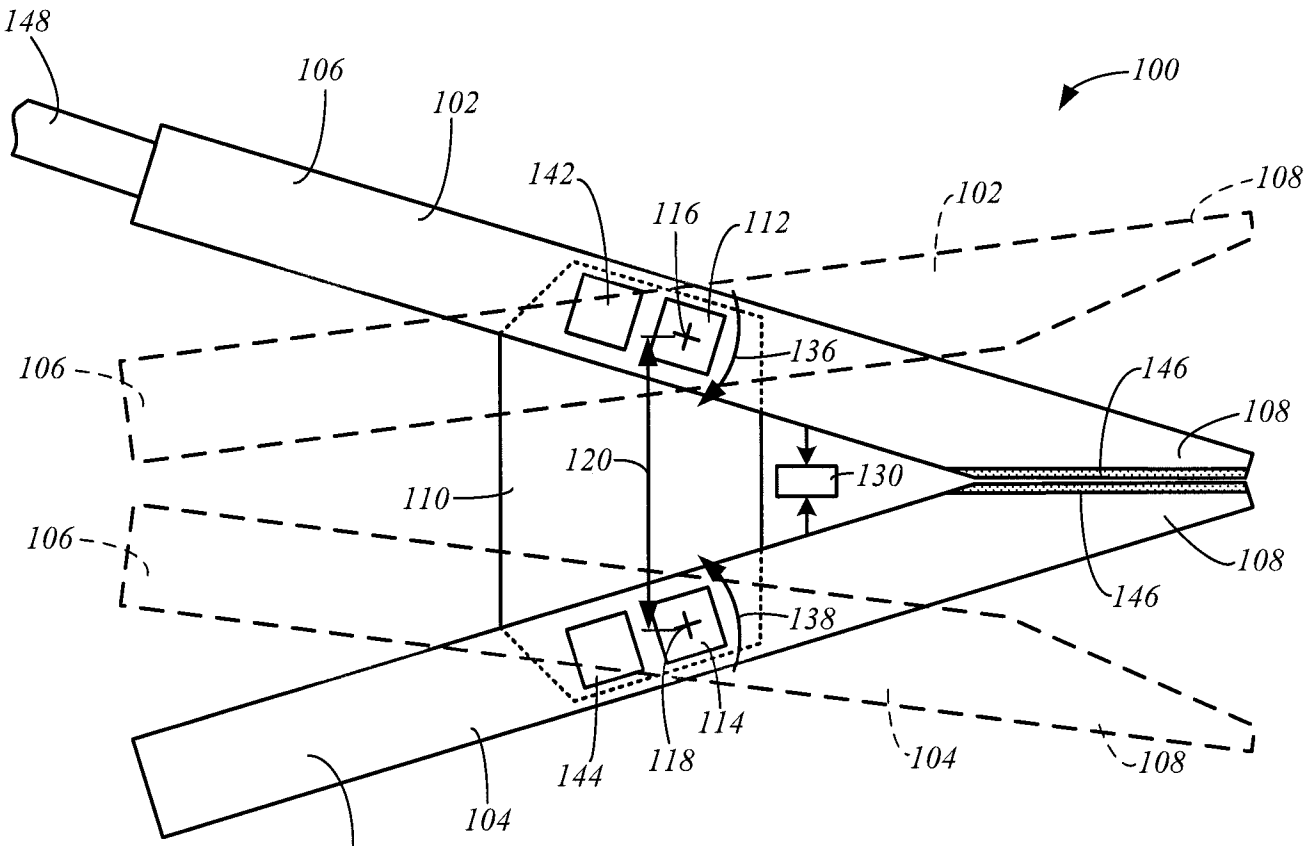
FIG. 1 is a simplified diagram of an exemplary clamp, in accordance with embodiments of the present disclosure.

Embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Specific details are given in the following description to provide a thorough understanding of the embodiments. However, it is understood by those of ordinary skill in the art that the embodiments may be practiced without these specific details. For example, circuits, systems, networks, processes, frames, supports, connectors, motors, processors, and other components may not be shown, or shown in block diagram form in order to not obscure the embodiments in unnecessary detail.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected," "coupled," or "attached" to another element, it can be directly connected, coupled or attached to the other element, or it can be indirectly connected, coupled, or attached to the other element where intervening or intermediate elements may be present. In contrast, if an element is referred to as being "directly connected," "directly coupled" or "directly attached" to another element, there are no intervening elements present. Drawings illustrating direct connections, couplings, or attachments between elements also include embodiments, in which the elements are indirectly connected, coupled or attached to each other.

It will be understood that, although the terms first, second, etc. may be used herein to describe various elements, these elements should not be limited by these terms. These terms are only used to distinguish one element from another. Thus, a first element could be termed a second element without departing from the teachings of the present disclosure.

Unless otherwise defined, all terms (including technical and scientific terms) used herein have the same meaning as commonly understood by one of ordinary skill in the art relating to the present disclosure. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments of the present disclosure are directed to a clamp for providing an electrical connection, such as, for example, a battery clamp for providing an electrical connection to a storage battery (e.g., an automotive battery) or a battery charger.

FIG. 1 is a simplified diagram of an exemplary clamp 100, in accordance with embodiments of the present disclosure. In some embodiments, the clamp 100 includes arms 102 and 104 each having a proximal end 106 and distal end 108. The clamp 100 also includes a joint member 110, which may be positioned between the arms 102 and 104.

Pivotable or rotatable connections 112 and 114 respectively connect the arms 102 and 104 to the joint member 110. The connection 112 between the arm 102 and the member 110 facilitates pivoting or rotational movement of the arm 102 about an axis 116 relative to the joint member 110, and the connection 114 between the arm 104 and the member 110 facilitates pivoting or rotational movement of the arm 104 relative to the member 110 about an axis 118. Thus, the pivotable connection 112 defines the axis 116 and the pivotable connection 114 defines the axis 118. The pivotable or rotatable connections 112 and 114 may take on any suitable form, such as a pivot joint, a hinge joint, a rotary joint, or another suitable pivotable or rotatable connection.

The axes 116 and 118 are separated from each other by a distance 120 in a direction that is perpendicular to the axis 116. In some embodiments, the axes 116 and 118 are substantially parallel to each other (i.e., ±15°), and the distance 120 extends along a plane that is parallel to the axes 116 and 118. In some exemplary embodiments, the distance 120 is approximately (i.e., ±10%) greater than 0.5 inch, greater than 1.0 inch, and greater than 2.0 inches.

Figure 5:
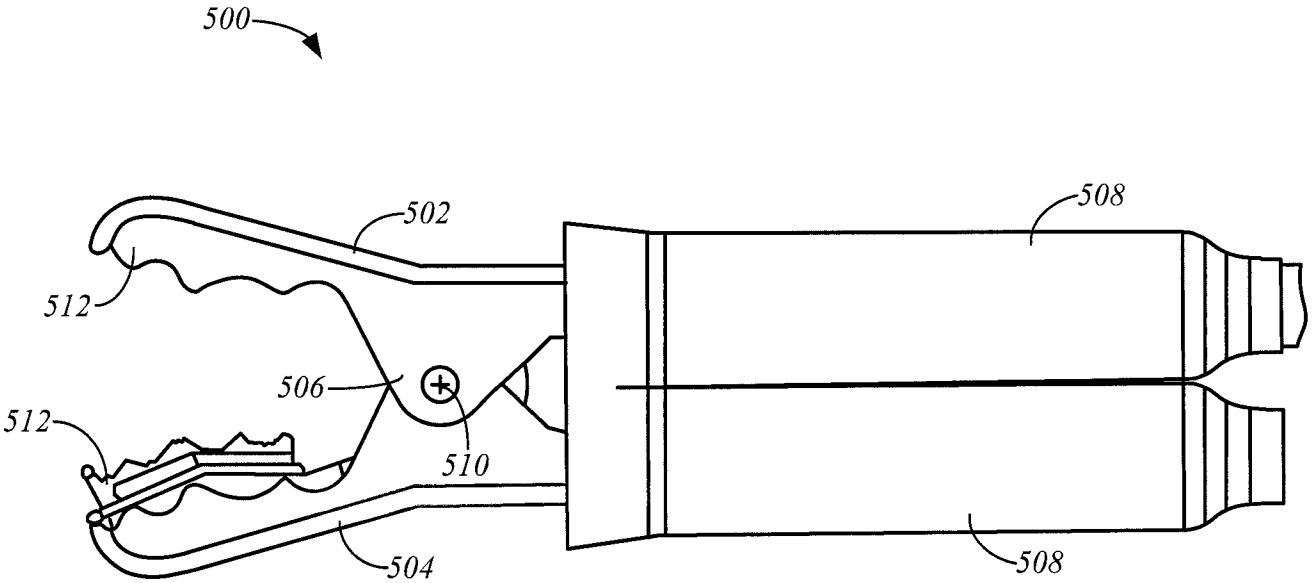
FIG. 5 (PRIOR ART)
FIG. 5 shows a side plan view of an exemplary clamp, in accordance with the prior art.

The dual pivotable connections 112 and 114 of the clamp 100, which results in the separated axes of rotation 116 and 118 for the arms 102 and 104, allow the distal ends 108 of the arms 102 and 104 to be configured to have a wider opened position (shown in phantom lines) than would be possible if the arms 102 and 104 were connected in the conventional manner to share the same axis of rotation, such as illustrated by the clamp 500 shown in FIG. 5. As a result, the clamp 100 formed in accordance with embodiments of the present disclosure, can be configured to have a wider gap between the distal ends 108 than conventional clamps, thereby allowing the clamp 100 to grip larger battery terminals or other items than conventional battery clamps. In some embodiments, the distal ends 108 of the arms 102 and 104 of the clamp 100 are capable of opening 50-60% wider than a similarly sized conventional single pivot point clamp, such as clamp 500 shown in FIG. 5.

In some embodiments, the clamp 100 includes a biasing mechanism 130 that is configured to bias the arms 102 and 104 toward a closed or gripping position, as shown in solid lines in FIG. 1. That is, the biasing mechanism 130 is configured to drive rotation of the arm 102 about the axis 116 relative to the member 110 in the direction indicated by arrow 136, and the biasing mechanism 130 is configured to drive rotation of the arm 104 about the axis 118 relative to the member 110 in the direction indicated by arrow 138. A user may overcome this biasing force applied to the arms 102 and 104 by squeezing the proximal ends 106 of the arms 102 and 104 together to transition the clamp 100 to an open position, which is indicated in phantom lines in FIG. 1. The biasing mechanism 130 may take on any suitable form and include one or more spring members, such as a coil spring, or another suitable biasing member.

The clamp 100 may also include cooperating features 142 and 144 for limiting the degree to which the arms 102 and 104 may pivot about their respective axes 116 and 118 relative to the member 110, to thereby limit the open and/or closed positions of the arms 102 and 104. The cooperating features 142 and 144 may take on any suitable form including those discussed in greater detail below.

In some embodiments, the distal end 108 of the arm 102 and/or the arm 104 includes one or more conductive members 146 that are configured to provide an electrical connection to a battery terminal or other feature gripped by the conductive members 146. The conductive members 146 may be electrically connected to each other through, for example, the member 110, and/or another electrically conductive element, such as an electrical cable.

In some embodiments, the clamp 100 includes an electrical cable 148 that is electrically coupled to at least one of the conductive members 146. When, for example, the clamp 100 is secured to a terminal of a battery, an electrical current is capable of flowing through at least one of the conductive members 146 and the cable 148 to a desired target, such as an automotive battery charger, a battery tester, or another target.

Figure 2:
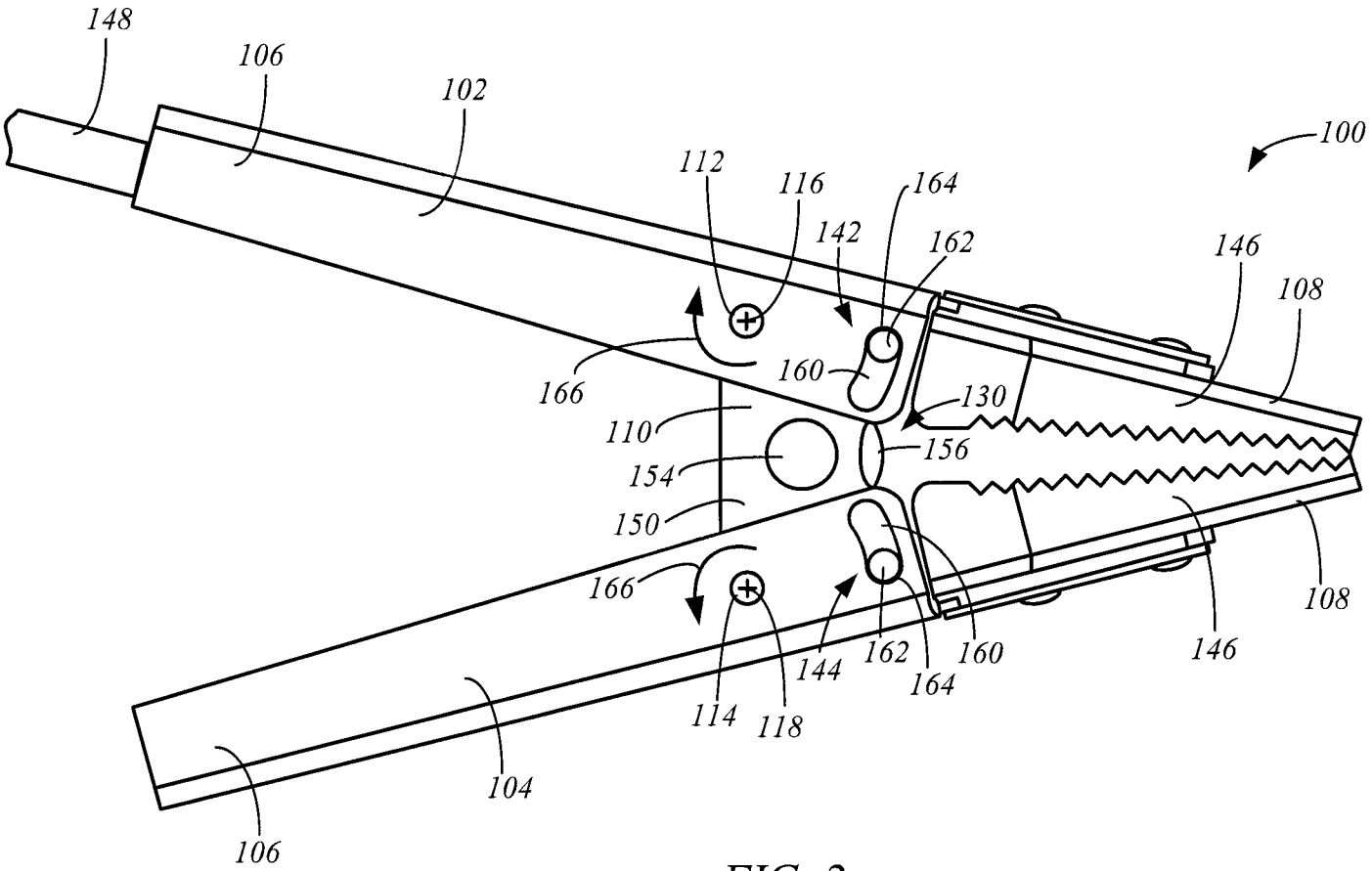
FIGS. 2 and 3 are side views of an exemplary clamp respectively in closed and opened positions, in accordance with embodiments of the present disclosure.
Figure 3:
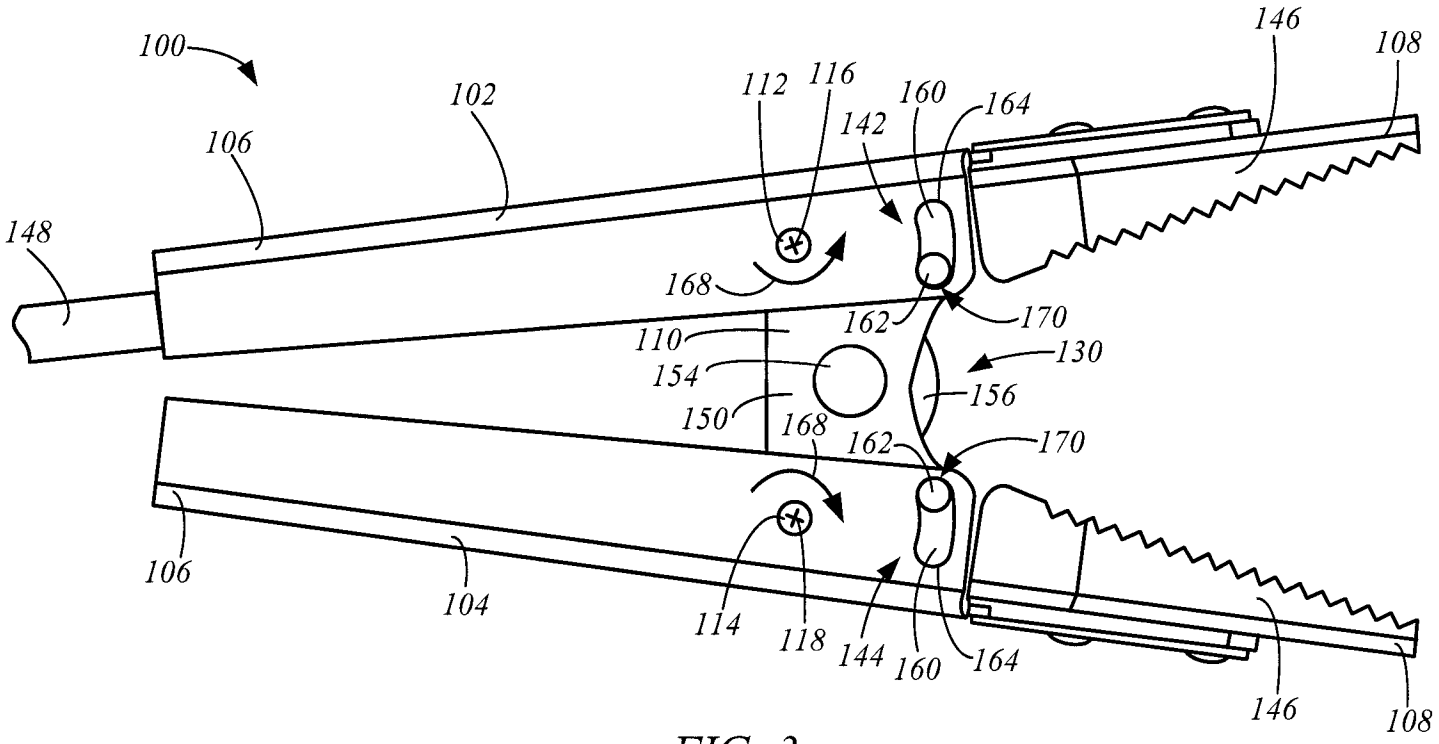
Figure 4:
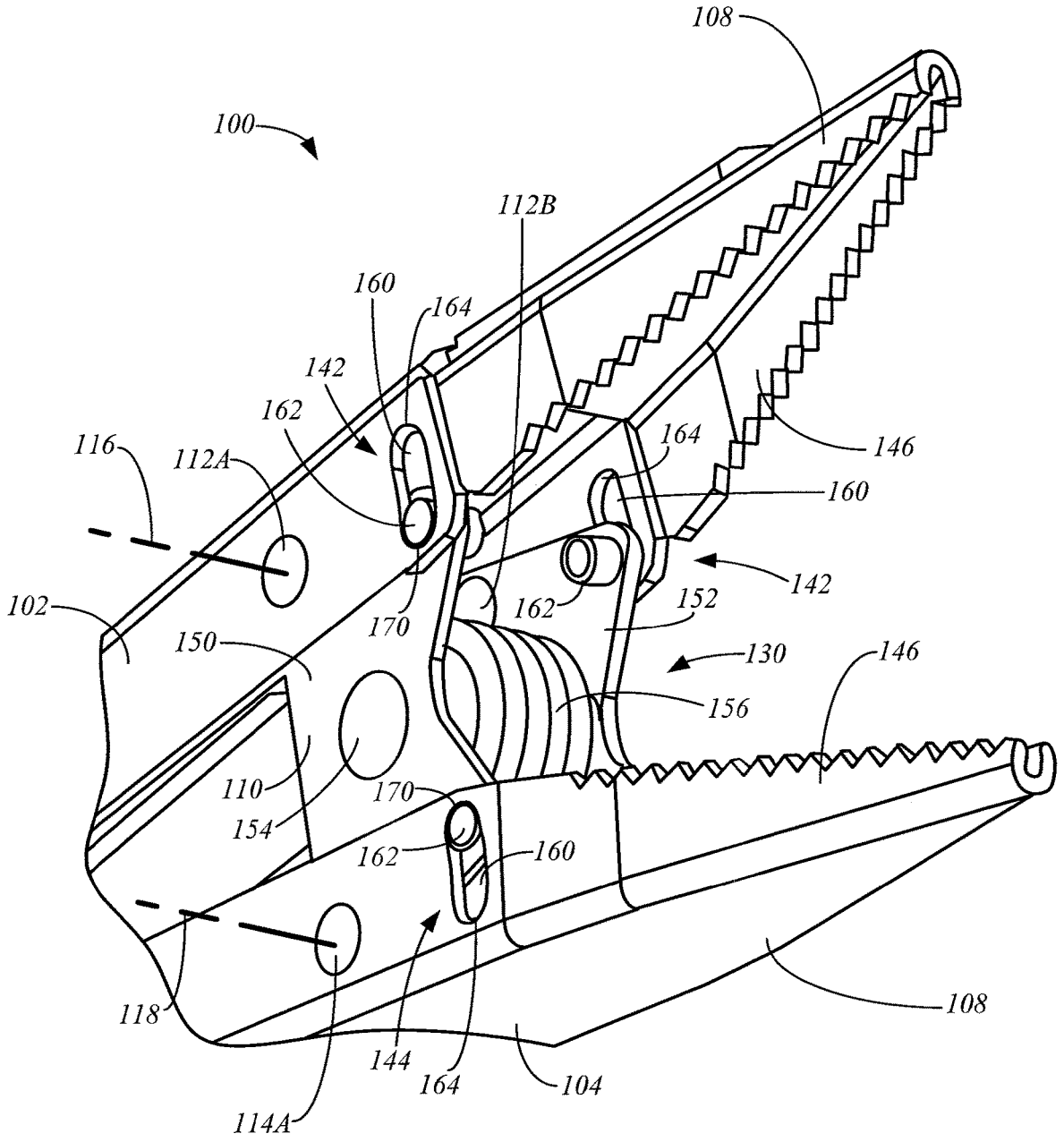
FIG. 4 is an isometric view of a distal end of an exemplary clamp, in accordance with embodiments of the present disclosure.

Additional embodiments of the present disclosure will be described with reference to FIGS. 2-4. FIGS. 2 and 3 are side views of an exemplary clamp 100 respectively in closed and opened positions, in accordance with embodiments of the present disclosure. FIG. 4 is an isometric view of a distal end of an exemplary clamp 100, in accordance with embodiments of the present disclosure. Elements that are identified using the same or similar reference numbers as those discussed above with reference to FIG. 1 correspond to the same or similar elements.

In some embodiments, the arms 102 and 104 are rigid structures, which may be formed of one or more components. For example, the arms 102 and 104 may be formed of one or more sheet metal components that may be bent into U-shaped cross-sections, such as shown in FIG. 4. Alternatively, the arms 102 and 104 may be tubular or solid structures, for example.

The joint member 110 may be formed in any suitable manner. In some embodiments, the joint member 110 includes side walls 150 and 152. The arm 102 is pivotably attached to one or both of the walls 150 and 152 of the member 110 through the pivotable connection 112. For instance, the arm 102 may be pivotably or rotatably attached to the wall 150 at a pivotable or rotatable connection 112A, and/or pivotably or rotatably attached to the wall 152 at a pivotable or rotatable connection 112B, as shown in FIG. 4. Similarly, the arm 104 may be pivotably or rotatably attached to one or both of the walls 150 and 152 through the pivotable connection 114. For instance, the arm 104 may be pivotably or rotatably attached to the wall 150 at a pivotable or rotatable connection 114A, and/or similarly pivotably or rotatably attached to the wall 152 through a suitable pivotable or rotatable connection (not shown). As mentioned above, each of the pivotable or rotatable connections 112 and 114 may take on any suitable form, such as a pivot joint, a hinge joint, or a rotary joint, for example.

The side walls 150 and 152 of the joint member 110 may be joined together using any suitable technique. In some embodiments, a pin or rod 154 extends between the walls 150 and 152. Other connections may also be made between the side walls 150 and 152.

In some embodiments, the pin 154 supports the biasing mechanism 130, which may include a spring member 156 (e.g., a coil spring), as best shown in FIG. 4, and/or another suitable biasing mechanism. In some embodiments, the spring 156 is coiled around the pin 154 and presses against the proximal side of the arms 102 and 104 (toward ends 106) from their corresponding pivotable connections 112 and 114 to the walls 150 and/or 152 of the member 110. This applies a biasing or closing force to the arms 102 and 104, which drives the arms 102 and 104 toward the closed position, shown in FIG. 1 (solid lines) and FIG. 2. A user may press the proximal ends 106 of the arms 102 and 104 together to overcome the closing force applied to the arms 102 and 104 by the spring 156, and transition the clamp 100 to the opened position shown in FIG. 1 (phantom lines), FIG. 3 and FIG. 4.

In some embodiments, the cooperating features 142 and 144 may include slots 160, and pins 162 that extend through the slots and limit the rotation of the arms 102 and 104 relative to the joint member 110. For example, the arms 102 and 104 may include the slots 170, and the member 110 may support a pair of pins 162 that extend through the slots 160 and restrict the angular rotation of the arms 102 and 104 about their corresponding pivot axes 116 and 118 relative to the member 110. In some embodiments, the closed position (FIG. 1) of the clamp 100 is partially determined by the pins 162 engaging an end 164 of the corresponding slot 160, as shown in FIG. 2. This engagement between the pins 162 and the ends 164 of the slots 160 prevents further rotation of the arms 102 and 104 about their pivot axes 116 and 118 in the direction indicated by arrows 166.

Similarly, in some embodiments, rotation of the arms 102 and 104 about their corresponding pivot axes 116 and 118 in the direction indicated by arrows 168 is limited by engagement between the pins 162 and an end 170 of the slots 160, as shown in FIG. 3. Thus, in some embodiments, the fully opened position of the clamp 100 is limited by the engagement between the pins 162 and the ends 170 of the slots 160, as shown in FIG. 3. In some embodiments, the cooperating features 142 and 144 limit a fully opened position to a position that prevents the proximal ends of the arms 102 and 104 from contacting each other. This may, for example, be useful in preventing abrasion to the cable 148 through contact with the proximal end 106 of the arm 104.

The slots 160 and pins 162 of the exemplary cooperating features 142 and 144 described above may be reversed. Thus, in some embodiments, the slots 160 may be formed in one or both of the walls 152 and 154 of the member 110, and the pins 162 may be attached to the arms 102 and 104. Other forms of the cooperating features 142 and 144 may also be used.

Although the embodiments of the present disclosure have been described with reference to preferred embodiments, workers skilled in the art will recognize that changes may be made in form and detail without departing from the spirit and scope of the present disclosure.

What is claimed is:

1. A clamp for providing an electrical connection to a battery comprising:

a first arm having a proximal end, a distal end, and an electrically conductive member at the distal end;

a second arm having a proximal end, and a distal end;

a joint member;

a first pivotable connection between the joint member and the first arm defining a first axis of rotation of the first arm, about which the first arm rotates relative to the joint member;

a second pivotable connection between the joint member and the second arm defining a second axis of rotation of the second arm, about which the second arm rotates relative to the joint member; and a biasing mechanism supported by the joint member and configured to bias the distal ends of the first and second arms toward each other;

wherein:

the first and second axes of rotation are displaced from each other in a direction that is perpendicular to the first axis of rotation; and the proximal ends of the first and second arms respectively extend from the first and second pivotable connections a distance configured to allow a user to overcome the bias applied to the distal ends of the first and second arms by the biasing mechanism by squeezing the proximal ends of the first and second arms together.

2. The clamp according to claim 1, wherein the first and second axes of rotation are substantially parallel to each other.

3. The clamp according to claim 2, wherein the first and second axes of rotation are displaced from each other a distance measured in a plane that is parallel to the first and second axes of rotation.

4. The clamp according to claim 3, wherein the distance is approximately greater than 0.5 inch.

5. The clamp according to claim 3, wherein the distance is approximately greater than 1.0 inch.

6. The clamp according to claim 3, wherein the distance is approximately greater than 2.0 inches.

7. The clamp according to claim 1, wherein the biasing mechanism comprises a spring member.

8. The clamp according to claim 7, wherein:

the joint member includes a pair of opposing side walls and a pin extending between the side walls; and the spring member is supported by the pin.

9. The clamp according to claim 1, wherein:

the first arm and the joint member include first cooperating features that are configured to limit a rotation of the first arm about the first axis of rotation relative to the joint member;

the second arm and the joint member include second cooperating features that are configured to limit rotation of the second arm relative to the joint member about the second axis of rotation; and the first and second cooperating features are displaced from the first and second pivotable connections.

10. The clamp according to claim 9, wherein the first and second cooperating features each include a slot and a pin, wherein the pin is received within the slot and is configured to slide within the slot from a first end of the slot to a second end of the slot.

11. The clamp according to claim 9, wherein the clamp includes an electrical cable that is electrically coupled to the conductive member.

12. The clamp according to claim 11, wherein the distal end of the second arm includes a conductive member that is electrically coupled to the electrical cable.

13. The clamp according to claim 1, wherein the first and second pivotable connections each include one of pivot joint, a hinge joint, and a rotary joint.

14. A clamp for providing an electrical connection to a battery comprising:

a first arm having a proximal end, a distal end, and an electrically conductive member at the distal end;

a second arm having a proximal end, and a distal end;

a joint member;

a first pivotable connection between the joint member and the first arm defining a first axis of rotation of the first arm, about which the first arm rotates relative to the joint member;

a second pivotable connection between the joint member and the second arm defining a second axis of rotation of the second arm, about which the second arm rotates relative to the joint member;

a biasing mechanism supported by the joint member and configured to bias the distal ends of the first and second arms toward each other; and an electrical cable that is electrically coupled to the conductive member;

wherein:

the first and second axes of rotation are substantially parallel to each other; and the first and second axes of rotation are displaced from each other in a direction that is perpendicular to the first axis the first arm and the joint member include first cooperating features that are configured to limit a rotation of the first arm about the first axis of rotation relative to the joint member;

the second arm and the joint member include second cooperating features that are configured to limit rotation of the second arm relative to the joint member about the second axis of rotation;

wherein the first and second cooperating features each include a slot and a pin that are displaced from the first and second pivotable connections, wherein the pin is received within the slot and is configured to slide within the slot from a first end of the slot to a second end of the slot.

15. The clamp according to claim 14, wherein:

the first and second axes of rotation are displaced from each other a distance measured in a plane that is parallel to the first and second axes of rotation; and the distance is selected from the group consisting of approximately greater than 0.5 inch, approximately greater than 1.0 inch, and approximately greater than 2.0 inches.

16. The clamp according to claim 15, wherein:

the joint member includes a pair of opposing side walls and a pin extending between the side walls; and the biasing mechanism includes a spring member that is supported by the pin.

17. The clamp according to claim 15, wherein the first and second pivotable connections each include one of pivot joint, a hinge joint, and a rotary joint.

18. The clamp according to claim 14, wherein the proximal ends of the first and second arms respectively extend from the first and second pivotable connections a distance configured to allow a user to overcome the bias applied to the distal ends of the first and second arms by the biasing mechanism by squeezing the proximal ends of the first and second arms together.

* * * * *